US005863689A

United States Patent [19]

Takei et al.

[11] Patent Number: 5,863,689

[45] Date of Patent: Jan. 26, 1999

[54] ELECTROPHOTOGRAPHIC PHOTORECEPTOR

[75] Inventors: Yoshiaki Takei; Yoshihiko Etoh; Asao Matsushima; Takeo Oshiba, all of Hachioji, Japan

[73] Assignee: Konica Corporation, Japan

[21] Appl. No.: 602,990

[22] Filed: Feb. 16, 1996

Related U.S. Application Data

[63] Continuation of Ser. No. 378,926, Jan. 25, 1995, abandoned, which is a continuation of Ser. No. 29,011, Mar. 10, 1993, abandoned.

[30] Foreign Application Priority Data

| | | | |
|---|---|---|---|
| Mar. 13, 1992 | [JP] | Japan | 4-055243 |
| Mar. 13, 1992 | [JP] | Japan | 4-055244 |
| Mar. 13, 1992 | [JP] | Japan | 4-055245 |
| Mar. 13, 1992 | [JP] | Japan | 4-055246 |

[51] Int. Cl.[6] ..... G03G 15/09

[52] U.S. Cl. ..... 430/83; 430/56; 430/58; 430/59; 430/905

[58] Field of Search ..... 430/83, 56, 58, 430/59, 905

[56] References Cited

U.S. PATENT DOCUMENTS

| | | | |
|---|---|---|---|
| 4,931,372 | 6/1990 | Takei et al. | 430/66 |
| 5,213,924 | 5/1993 | Sakamoto | 430/58 |

FOREIGN PATENT DOCUMENTS

| | | | |
|---|---|---|---|
| 486038 | 5/1992 | European Pat. Off. | G03G 5/05 |
| 1505409 | 3/1978 | United Kingdom . | |

*Primary Examiner*—Mark Chapman

*Attorney, Agent, or Firm*—Jordan B. Bierman; Bierman, Muserlian and Lucas LLP

[57] ABSTRACT

Disclosed is an electrophotographic photoreceptor comprising an electrically conductive support and thereon formed a light-sensitive layer containing a carrier generation material, a carrier transport material and a binder resin, wherein said light-sensitive layer comprises a copolymer having a structural unit represented by Formula $B_1$ and Formula $B_2$;

wherein $R_1$ and $R_2$ independently represent a hydrogen atom, an alkyl group having 1 to 6 carbon atoms, or an aryl group, $R_1$ and $R_2$ may combine together to form a cyclic hydrocarbon residue having 4 to 10 carbon atoms, $R_3$, $R_4$, $R_5$ and $R_6$ independently represent a hydrogen atom, a halogen atom, an alkyl group having 1 to 6 carbon atoms, a cyclic hydrocarbon residue having 4 to 10 carbon atoms, or an aryl group, l, m, p and q independently represent an integer of 1 to 4. The electrophotographic photoreceptor has high sensitivity and high durability.

13 Claims, 1 Drawing Sheet

ELECTROPHOTOGRAPHIC PHOTORECEPTOR

This application is a continuation of application Ser. No. 08/378,926, filed Jan. 25, 1995, now abandoned, which is a continuation of application Ser. No. 08/029,011, filed Mar. 10, 1993, now abandoned.

FIELD OF THE INVENTION

The present invention relates to an electrophotographic photoreceptor, more specifically an organic photoelectrically conductive electrophotographic photoreceptor and film properties of electrophotographic photoreceptor structural layers.

BACKGROUND OF THE INVENTION

In electrophotographic copying machines based on Carlson's method, charging the surface of a photoreceptor is followed by exposure for imagewise charge removal to form an electrostatic latent image, which is developed with a toner, and the resulting visible image is transferred and fixed onto a transferee such as paper.

At the same time, the photoreceptor is treated to remove the adhering toner, eliminate the carrier and clean the surface to ensure long-term repeated use.

Therefore, the electrophotographic photoreceptor is required to be good in physical properties such as printability, wear resistance and moisture resistance in repeated use and resistance to ozone generated upon corona discharge and to ultraviolet rays generated upon exposure (environmental resistance), as well as in chargeability and electrophotographic properties such as high sensitivity and low dark decay.

Conventional electrophotographic photoreceptors in common use are inorganic photoreceptors having a light-sensitive layer based mainly on an inorganic photoelectrically conductive material such as selenium, zinc oxide or cadmium sulfide.

In recent years, there has been a trend toward development of organic electrophotographic photoreceptors of high sensitivity and high durability wherein the carrier generation and carrier transport functions are allotted to different substances in a light-sensitive layer, which substances are selected over a wide range to exhibit the respective functions according to the desired characteristics.

Such organic photoreceptors of the separate function type have traditionally been used mainly for negative charging; a thin carrier generation layer is formed on the support, on which a relatively thick carrier transport layer is formed.

As a binder for such photoreceptors, polycarbonate of the bisphenol A type represented by the following structural formula is well known to offer good properties in terms of chargeability, sensitivity, residual potential and durability in repeated use.

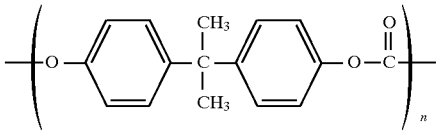

Polycarbonates of the above structural unit are hereinafter referred to as of the BPA type. This type of polycarbonate has a structure wherein two methyl groups are symmetrically bound to the central carbon atom of bisphenol A.

Investigations have revealed, however, that this type of polycarbonate has the following drawbacks:

(1) Mechanical strength, especially flaw resistance and wear resistance are not sufficient to allow satisfactory improvement in organic photoreceptor durability.

(2) Poor compatibility with carrier transport material (CTM) easily results in CTM crystal separation, which can lead to cracking and other troubles in the coating film.

(3) Using a hot coating solution for dip coating etc. tends to cause coating solution gelation.

(4) Gel projection on the light-sensitive layer surface causes toner filming upon cleaning, which is likely to result in an imaging failure.

(5) Severe abrasion by cleaning blade etc. hampers the improvement of organic photoreceptor durability.

Herein after referred to as Japanese Patent Publication Open to Public Inspection No. 172045/1985 propose non-crystalline polycarbonates such as those having a bulky substituent and those of the Z type wherein a ring has been formed at the central carbon atom. The use of the polycarbonate having a bulky substituent or the polycarbonate of the Z type eliminated the above-described drawback in the polycarbonate of the BPA type. However, due to photoreceptor fatigue deterioration by ozone generated upon corona discharge and other active substances generated upon imagewise exposure, durability in long-term image formation was insufficient. To overcome this problem, Japanese Patent O.P.I. Publication Nos. 118137/1989, propose the addition of an antioxidant comprising a compound having a hindered phenolic structural unit and/or a hindered amine structural unit to the polycarbonate having a bulky substituent, or a polycarbonate of the A or Z type, or a polycarbonate resulting from copolymerization of these polycarbonate structural units.

Japanese Patent O.P.I. Publication No. 20768/1991 proposes a method for improving the blade cleaning property by using as a binder a polycarbonate resin of the bisphenol Z type on the surface of the light-sensitive layer. The same publication describes improvements in light-sensitive material's resistance to wear by the cleaning blade, ozonic deterioration during charging and other film properties of the light-sensitive layer.

However, with the popularization of copying machines, there is demand for improved image quality, high copying speed and high durability.

Particularly the OPC photoreceptor is more sensitive to light-sensitive layer wear in multiple imaging, so that the electrophotographic performance is liable to deteriorate, in comparison with other types of photoreceptors such as those of selenium; there is demand for the development of a binder resin having still better wear resistance. In addition, in manufacturing a copying machine, cleaning elements, such as the cleaning blade, are usually produced pressed against the electrophotographic photoreceptor, and its storage, transport, etc. often require a long period of several months or sometimes over 1 year, until it is used by a user. This poses a problem of image failures such as black streaks and white streaks due to cracking upon imaging as a result of the action of unreacted components, such as polyol, of the cleaning blade etc. on the light-sensitive layer.

Meantime, since high image quality and good copying workability depend also on surface smoothness and evenness in the photoreceptor of uniform thickness, the coating composition for constituting the coated structural layer of the photoreceptor and film failures such as orange peel, pinholes, coating streaks and solvent cracks occurring upon coating or drying are of major concern from the viewpoint of copying performance and production efficiency.

Surfactants are also useful in improving surface quality or lubrication and also effective in improving suspensoid dispersibility and dispersion stability in the case of coating suspensions and valuable in promoting dissolution and improving coatability and other properties related to productivity in the case of coating solutions. However, a mistakenly chosen surfactant often causes poor layer-to-layer adhesion, deterioration-related failures or troubles due to a lack of moisture resistance.

To overcome these drawbacks, there have been various proposals, including, use of a copolymer of monomers resulting from substitution of both phenylene rings with a phenyl group or a cyclohexyl group (Japanese Patent O.P.I. Publication Nos. 269942/1989) and use of distyryl, as a carrier transport material, in combination with a polycarbonate of the bisphenol Z type (Japanese Patent O.P.I. Publication No. 32265/1989). However, there remain some problems, such as insufficient surface strength and surface smoothness, a lack of wear and crack resistance, image quality deterioration in repeated use, and sensitivity deterioration due to wear-related film thinning.

SUMMARY OF THE INVENTION

It is an object of the present invention to provide an electrophotographic photoreceptor of high sensitivity wherein the mechanical durability of the electrophotographic photoreceptor light-sensitive layer is high, the surface smoothness is good, the crack resistance and ozone resistance are good, and the incidence of image quality deterioration and sensitivity deterioration is low.

It is another object of the present invention to provide an electrophotographic photoreceptor which is excellent in film forming performance, mechanical strength and wear resistance, high in sensitivity and excellent in long-term durability in repeated use.

It is still another object of the present invention to provide an image forming method wherein electrophotographic properties show little deterioration due to light-sensitive layer wear during multiple repeated imaging, the use of a photoreceptor containing a particular polymer as a binder offers excellent storage stability from the manufacturing of the copying machine to use thereof by a user and prevents cracking caused by the cleaning blade of polyurethane in contact with the surface of the photoreceptor surface.

Figure 1:
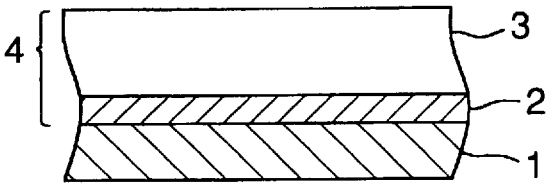
FIG. 1 is a cross-sectional view of embodiments of the electrophotographic photoreceptor of the present invention, showing the structural configuration thereof, wherein the numerical symbols denote the following.
Figure 1:
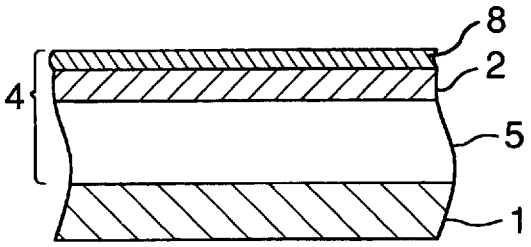
Figure 1:
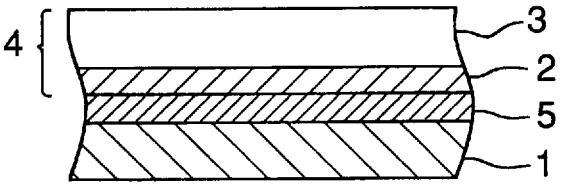
Figure 1:
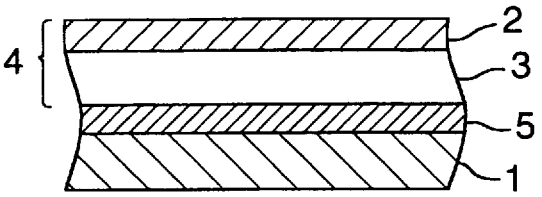
Figure 1:
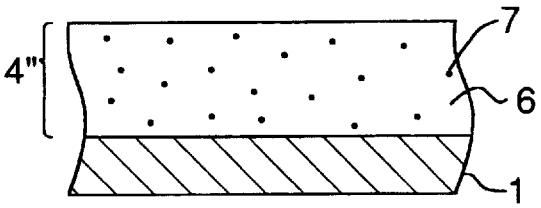
Figure 1:
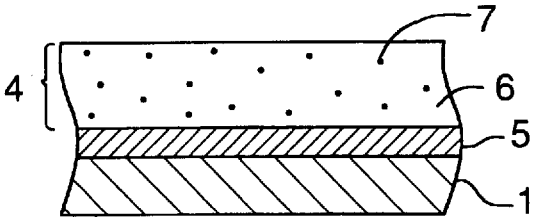

1: Electrically conductive support
2: Carrier generation layer (CGL)
3: Carrier transport layer (CTL)
4: Light-sensitive layer
5: Intermediate layer
6: Layer containing carrier transport material
7: Carrier generation material (CGM)
8: Protective layer

DETAILED DESCRIPTION OF THE PREFERRED EMBODIMENT

The above-described first object of the present invention is accomplished by an electrophotographic photoreceptor comprising an electrically conductive support and a light-sensitive layer formed thereon and containing at least a carrier generation material, a carrier transport material and a binder resin, wherein the light-sensitive layer contains a copolymer compound based on a structural unit represented by the following formula $B_1$ and another structural unit represented by the following formula $B_2$, as a binder resin, and a carrier transport material represented by the following formula T or formula U, preferably formula T.

The above-described second object of the present invention is accomplished by an electrophotographic photoreceptor comprising an electrically conductive support and a light-sensitive layer formed thereon and containing at least a carrier generation material, a carrier transport material and a binder resin, wherein the light-sensitive layer contains a copolymer compound based on a structural unit represented by the following formula $B_1$ and another structural unit represented by the following formula $B_2$, as a binder resin, and another compound having in its molecular structure a hindered phenolic structural unit and/or a hindered amine structural unit.

The above-described third object of the present invention is accomplished by an image forming method including a process of cleaning the photoreceptor while keeping a cleaning blade of urethane rubber in contact with the surface layer of the photoreceptor, wherein the surface layer contains as a binder resin a copolymer compound based on structural units represented by the following formulas $B_1$ and $B_2$.

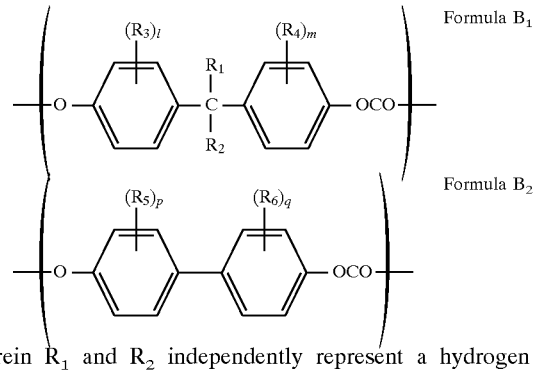

wherein $R_1$ and $R_2$ independently represent a hydrogen atom, a substituted or unsubstituted alkyl group having 1 to 6 carbon atoms, or a substituted or unsubstituted aryl group such as a phenyl group or a naphthyl group; $R_1$ and $R_2$ may bind together to form a $C_4$–$C_{10}$ cyclic hydrocarbon residue.

$R_3$, $R_4$, $R_5$ and $R_6$ independently represent a hydrogen atom, a halogen atom, a substituted or unsubstituted alkyl group having 1 to 6 carbon atoms, or a substituted or unsubstituted aryl group such as a phenyl group or a naphthyl group.

l, m, p and q independently represent an integer of 1 to 4.

Preferably, the electrophotographic photoreceptor contains a copolymer compound having the following structural units for the above formulas $B_1$ and $B_2$.

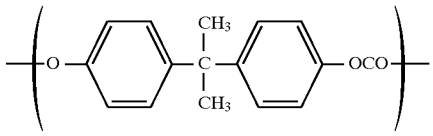

-continued

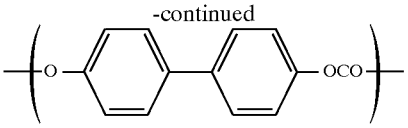

The degree of polymerization of the polymer or copolymer is 10 to 5000, preferably 50 to 1000.

In the present invention, the use of a copolymer containing structural units represented by the above formulas $B_1$ and $B_2$ as a binder resin makes it possible to form an electrophotographic photoreceptor which is excellent in film properties, excellent in electrophotographic properties such as charge retention, sensitivity and residual potential and which exhibits constant performance with little fatigue deterioration even in repeated use.

Other monomers can be used as necessary, as long as their addition does not interfere with the desired action or effect. In this case, the mixing ratio is preferably not higher than 50% by weight.

The copolymer compound of the present invention can easily be synthesized by a conventional method using a phenolic compound selected from the group comprising the following I and II.

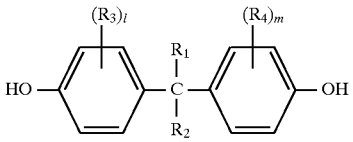

(I)

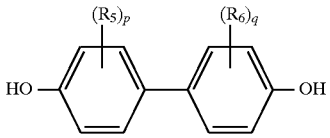

(II)

wherein $R_1$, $R_2$, $R_3$, $R_4$, $R_5$, $R_6$, l, m, p and q are identical with those mentioned for the above formulas $B_1$ and $B_2$.

The copolymer compound of the present invention can be produced by reacting the above phenolic compound with phosgene in the presence of an inert solvent such as methylene chloride or 1,2-dichloroethane and an acid recipient such as an aqueous alkali solution or pyridine.

When using an aqueous alkali solution as an acid recipient, the use of a tertiary amine such as trimethylamine or triethylamine, or a quaternary ammonium compound such as tetrabutylammonium chloride or benzyltributylammonium bromide, as catalyst, increases the reaction rate.

Also, a monohydric phenol such as phenol or p-t-butylphenol, as a molecular weight regulator, may be coexist as necessary. The catalyst may be present at the beginning, or may be added after oligomer preparation to increase the molecular weight.

In the present invention, copolymerization of two or more types of phenolic compounds can be achieved by any optionally chosen method, including:

(a) a method wherein the two or more types of phenolic compounds are first reacted with phosgene at the same time to yield the desired copolymer, (b) a method wherein some phenolic compounds are first reacted with phosgene and, after a given period of reaction, the remaining are added, to yield the desired copolymer, and (c) a method wherein the two or more types of phenolic compounds are separately reacted with phosgene for polymerization.

Examples of structures represented by formulas $B_1$ and $B_2$ are given below, but the present invention is by no means limited to these examples.

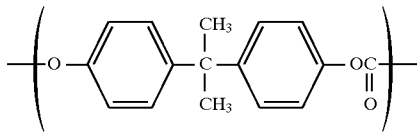

$B_1$-1

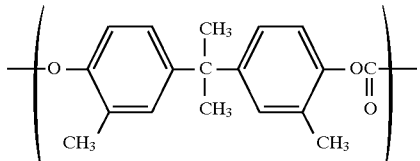

$B_1$-2

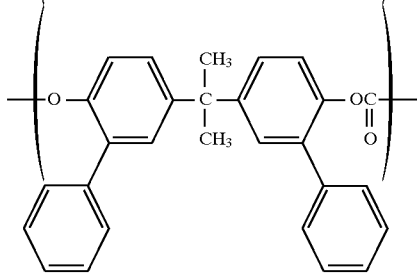

$B_1$-3

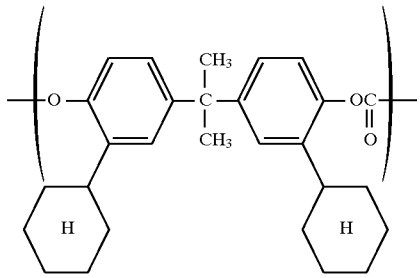

$B_1$-4

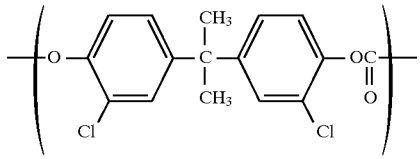

$B_1$-5

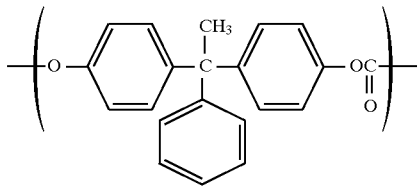

$B_1$-6

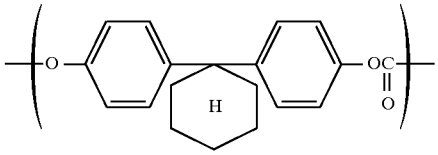

$B_1$-7

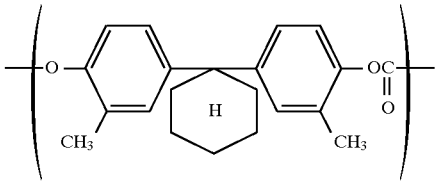

$B_1$-8

-continued
$B_1$-9
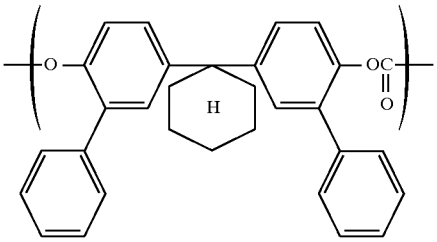
$B_1$-10
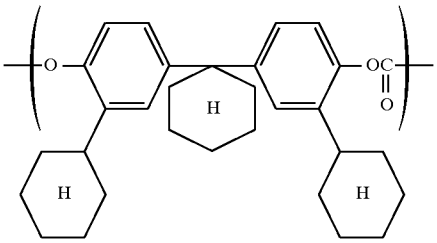
$B_1$-11
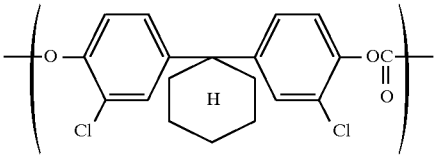
$B_1$-12
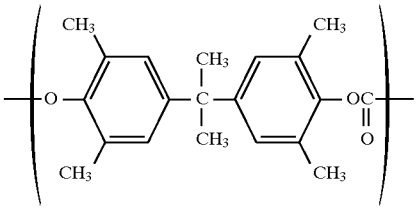
$B_1$-13
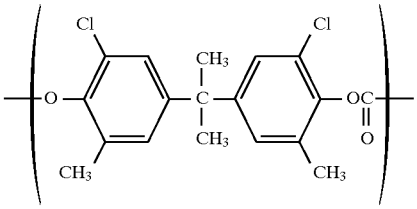
$B_1$-14
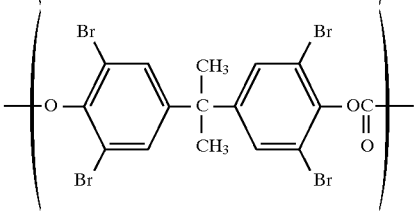
$B_1$-15
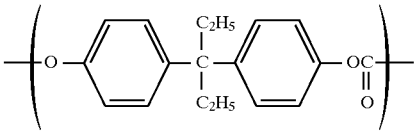
$B_1$-16
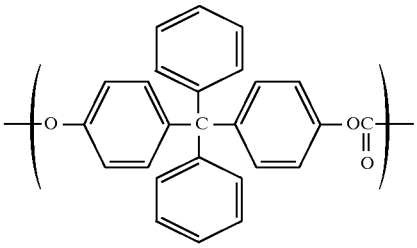
-continued
$B_2$-1
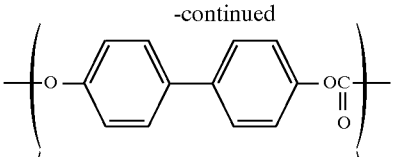
$B_2$-2
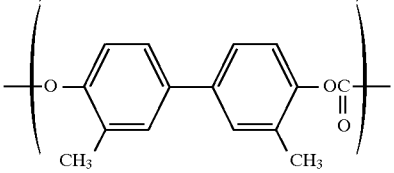
$B_2$-3
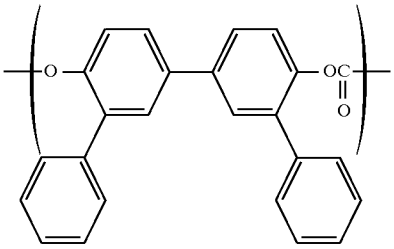
$B_2$-4
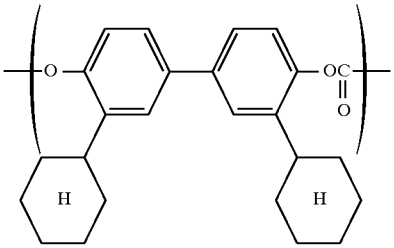
$B_2$-5
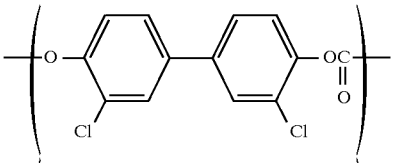
$B_2$-6
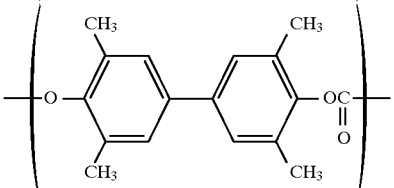
$B_2$-7
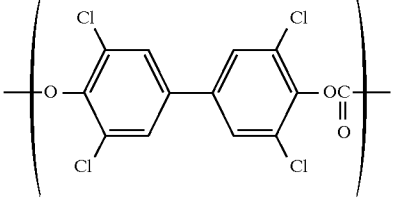
Examples of copolymer compounds of the above structures are given below, but the present invention is not limited to these examples.
TABLE 1
| No. | Copolymer compound example |
|---|---|
| B-1 | $(B_1-1)x/(B_2-1)y$ |
| B-2 | $(B_1-2)x/(B_2-1)y$ |
| B-3 | $(B_1-3)x/(B_2-1)y$ |
| B-4 | $(B_1-4)x/(B_2-1)y$ |
| B-5 | $(B_1-5)x/(B_2-1)y$ |
| B-6 | $(B_1-6)x/(B_2-1)y$ |

TABLE 1-continued

| No. | Copolymer compound example |
|---|---|
| B-7 | $(B_1-7)x/(B_2-1)y$ |
| B-8 | $(B_1-8)x/(B_2-1)y$ |
| B-9 | $(B_1-9)x/(B_2-1)y$ |
| B-10 | $(B_1-10)x/(B_2-1)y$ |
| B-11 | $(B_1-11)x/(B_2-1)y$ |
| B-12 | $(B_1-1)x/(B_2-2)y$ |
| B-13 | $(B_1-2)x/(B_2-2)y$ |
| B-14 | $(B_1-6)x/(B_2-2)y$ |
| B-15 | $(B_1-7)x/(B_2-2)y$ |
| B-16 | $(B_1-8)x/(B_2-2)y$ |
| B-17 | $(B_1-9)x/(B_2-2)y$ |
| B-18 | $(B_1-1)x/(B_1-5)y$ |
| B-19 | $(B_1-2)x/(B_1-5)y$ |
| B-20 | $(B_1-7)x/(B_1-5)y$ |
| B-21 | $(B_1-8)x/(B_1-5)y$ |
| B-22 | $(B_1-1)x/(B_1-6)y$ |
| B-23 | $(B_1-2)x/(B_1-6)y$ |
| B-24 | $(B_1-7)x/(B_1-6)y$ |
| B-25 | $(B_1-8)x/(B_1-6)y$ |

The ratio of x and y (copolymer ratio) in the copolymer compounds listed above normally falls in the range of 95:5 to 5:95, preferably 95:5 to 50:50.

It is preferable to keep the percent ratio of y not higher than 50 mol%.

Example binders which can be used in combination with the copolymer compound of the present invention are given below.

(1) Polyester
(2) Methacrylic resin
(3) Acrylic resin
(4) Polyvinyl chloride
(5) Polyvinylidene chloride
(6) Polystyrene
(7) Polyvinyl acetate
(8) Styrene copolymer resins such as styrene-butadiene copolymer and styrene-methyl methacrylate copolymer
(9) Acrylonitrile copolymer resins such as vinylidene chloride-acrylonitrile copolymer
(10) Vinyl chloride-vinyl acetate copolymer
(11) Vinyl chloride-vinyl acetate-maleic anhydride copolymer
(12) Silicone resin
(13) Silicone-alkyd resin
(14) Phenolic resins such as phenol-formaldehyde resin and cresol-formaldehyde resin
(15) Styrene-alkyd resin
(16) Poly-N-vinylcarbazole
(17) Polyvinyl butyral
(18) Polyvinyl formal
(19) Polyhydroxystyrene These binders may be used singly or in a mixture of two or more kinds, in combination with the copolymer compound relating to the present invention.

The carrier transport material (CTM) represented by formula T is described below.

Formula T

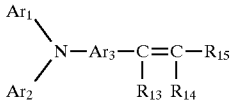

wherein $Ar_1$ and $Ar_2$ independently represent an aliphatic group or an aromatic group, and $Ar_1$ and $Ar_2$ are preferably a phenyl group which may have a substituent, and a substituent is preferably an alkyl group, an alkoxyl group or a hlogen atom; $Ar_3$ represents a phenylene group; $Ar_1$ and $Ar_3$ may bind together to form a ring. $R_{13}$ and $R_{14}$ independently represent a hydrogen atom, an alkyl group or an aromatic group; $R_{15}$ represents an alkyl group or an aryl group. $R_{13}$ is preferably a hydrogen atom $R_{14}$ and $R_{15}$ are preferably a hydrogen atom or a phenyl group, and further preferably at least one of $R_{14}$ and $R_{15}$ is a phenyl group.

The above aryl group is a phenyl group, a naphthyl group or a condensed polycyclic ring. The aliphatic group and aromatic group for $Ar_1$, $Ar_2$, $Ar_3$, $R_{13}$, $R_{14}$ and $R_{15}$ may contain a substituent such as an alkyl group, an alkoxy group, a halogen atom or an amino group. $Ar_1$ and $Ar_2$ may bind together to form a ring such as a carbazole ring or an indoline ring. The ring formed by $R_{14}$ and $R_{15}$ is a 5- to 7-membered carbon ring or heterocyclic ring.

Formula T is preferably represented by Formula $T_1$.

Formula $T_1$

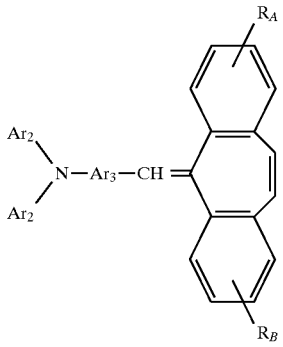

$R_A$ and $R_B$ independently represent a hydrogen atom, an alkyl group.

Having good performance for CTM, the above compounds are favorable for increasing the sensitivity.

Example compounds represented by formula T or Formula $T_1$ are given below, which are not to be construed as limitative.

Example compounds of Formula T and Formula $T_1$

T-1

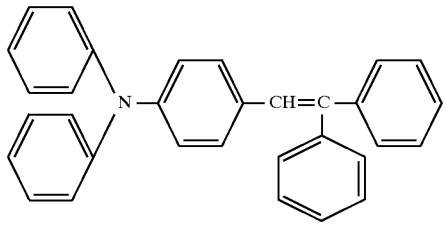

T-2

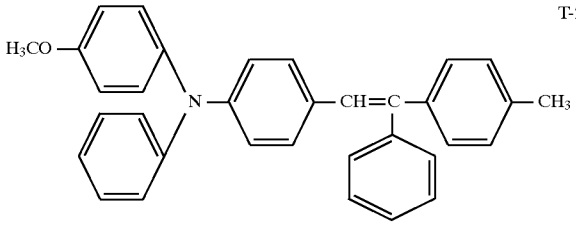

-continued
T-3
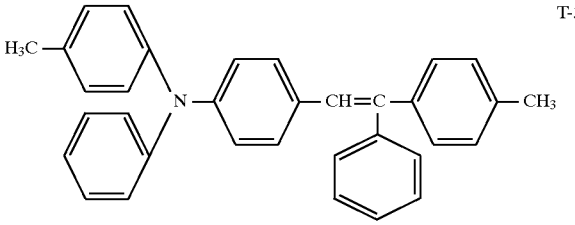
T-4
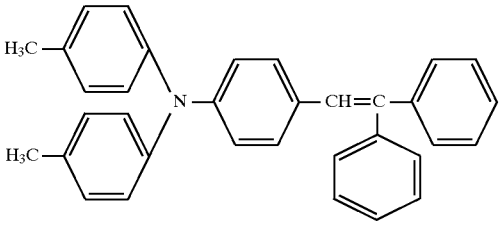
T-5
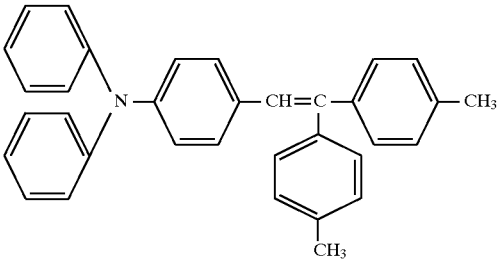
T-6
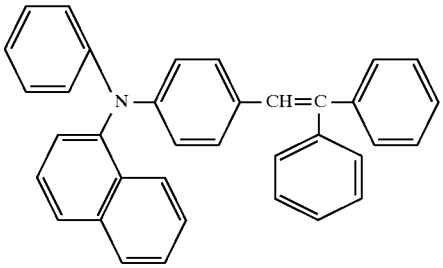
T-7
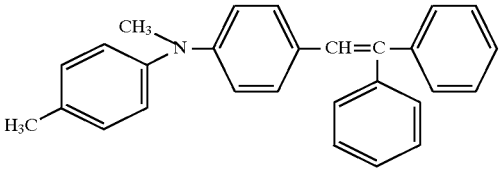
T-8
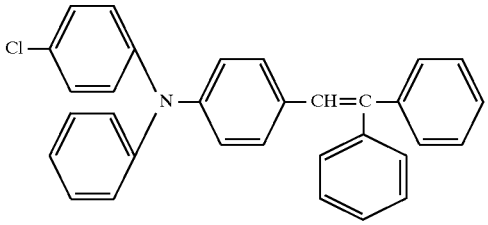
T-9
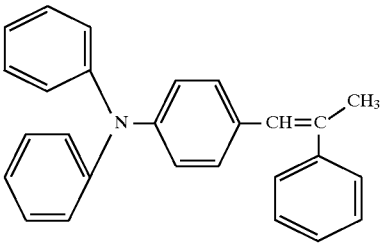
-continued
T-10
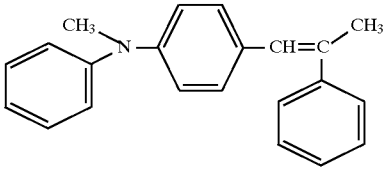
T-11
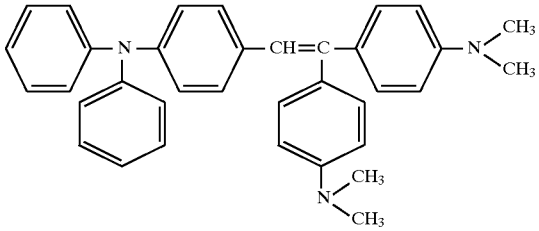
T-12
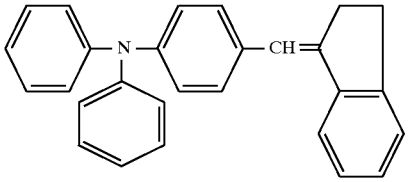
T-13
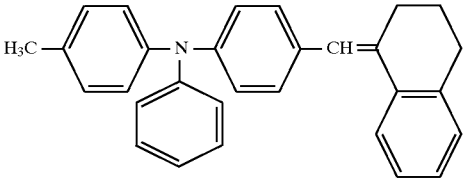
T-14
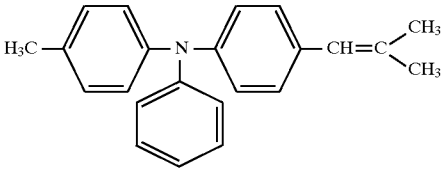
T-15
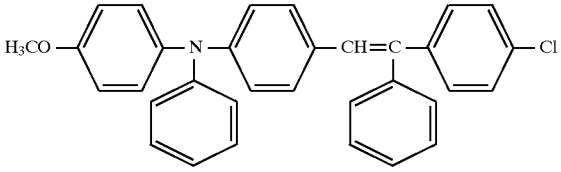
T-16
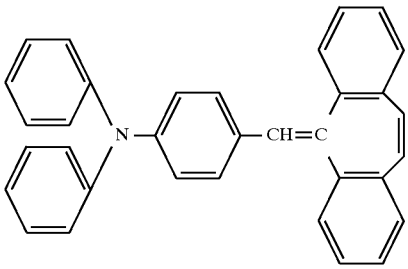

-continued

T-17

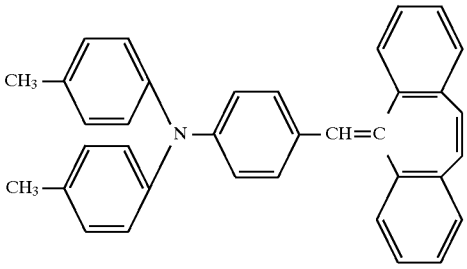

T-18

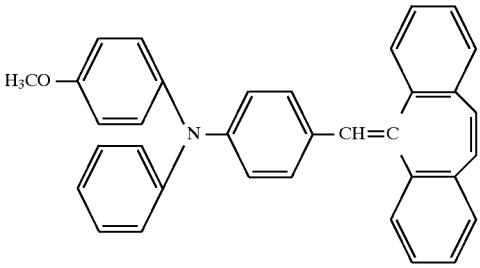

T-19

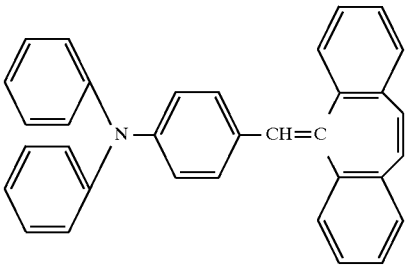

T-20

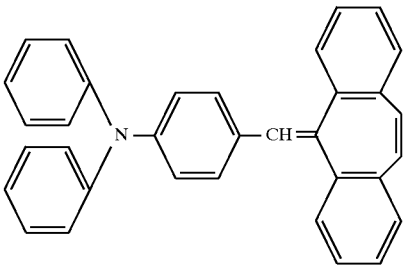

T-21

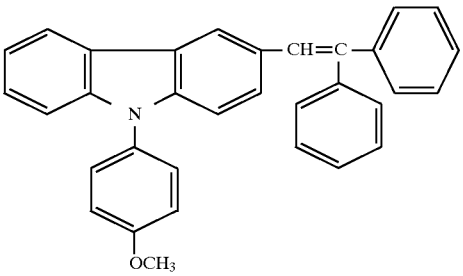

T-22

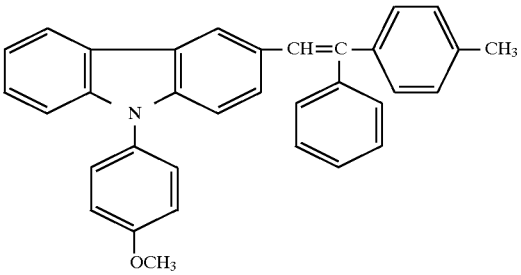

-continued

T-23

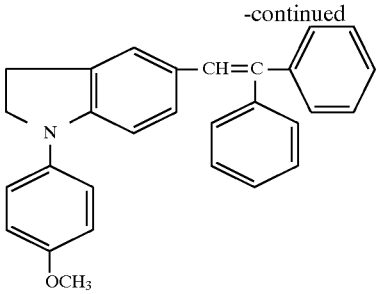

T-24

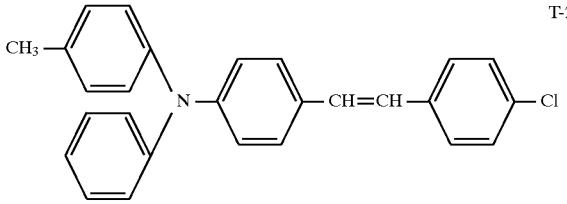

T-25

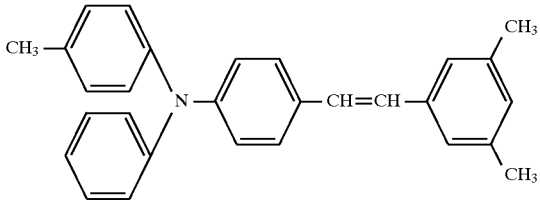

T-26

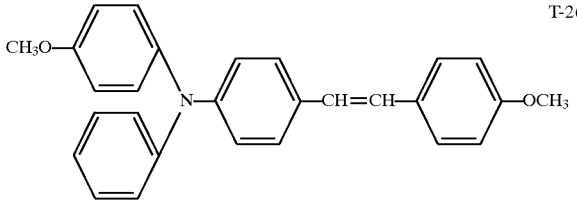

The carrier transport material (CTM) represented by formula U is described below.

Formula U

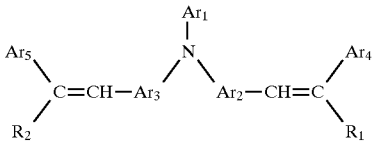

wherein $Ar_1$ represents a phenyl group substituted by $(R_3)i$ or a condensed polycyclic hydrocarbon group, heterocyclic group or condensed polycyclic heterocyclic group, whether substituted or unsubstituted.

$Ar_2$ and $Ar_3$ independently represent a phenylene group substituted by $(R_4)j$ or a condensed polycyclic hydrocarbon group, heterocyclic group or condensed polycyclic heterocyclic group, whether substituted or unsubstituted.

$Ar_4$, $Ar_5$, $R_1$ and $R_2$ independently represent a phenyl group substituted by $(R_5)k$ or a condensed polycyclic hydrocarbon group, heterocyclic group or condensed polycyclic heterocyclic group, whether substituted or unsubstituted.

$R_1$ and $R_2$ may cooperate with $Ar_4$ and $Ar_5$ to form a ring.

$R_3$ represents a substituted or unsubstituted alkyl group, a phenyl group, an alkoxy group, a phenoxy group, a cyano group, a halogen atom, a carboxyl group, an acyl group, a hydroxyl group, a nitro group, an amino group, a substituted or unsubstituted alkylamino group, arylamino group, aralkylamino group, cyclic hydrocarbon group, condensed polycyclic hydrocarbon group or heterocyclic group.

$R_4$ and $R_5$ independently represent a substituted or unsubstituted alkyl group, phenyl group, alkoxy group or phenoxy group, or a cyano group, a halogen atom, a carboxyl group, an acyl group, a hydroxy group, a nitro group, an amino group or a substituted or unsubstituted alkylamino group, arylamino group, aralkylamino group, cyclic hydrocarbon group, condensed polycyclic hydrocarbon group or heterocyclic group.

i and k independently represent an integer of 0 to 5, and j represents an integer of 0 to 4.

Examples of CTM of the present invention of the above formula U are given below, which are not to be construed as limitative.

U-1

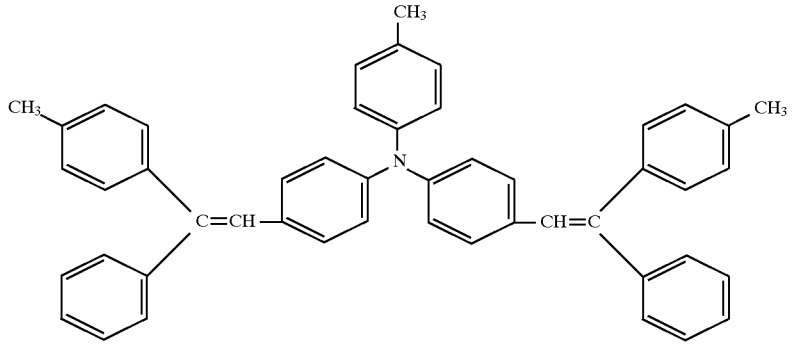

U-2

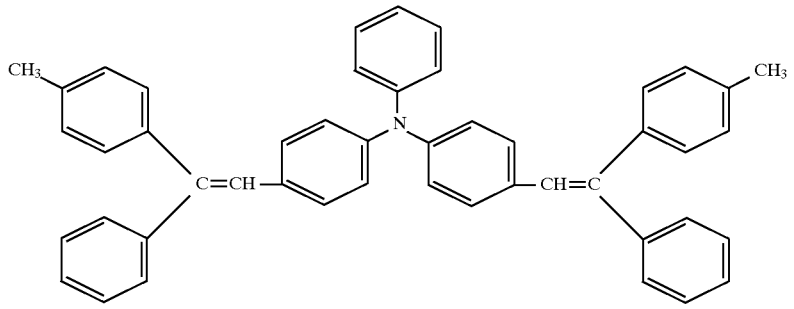

U-3

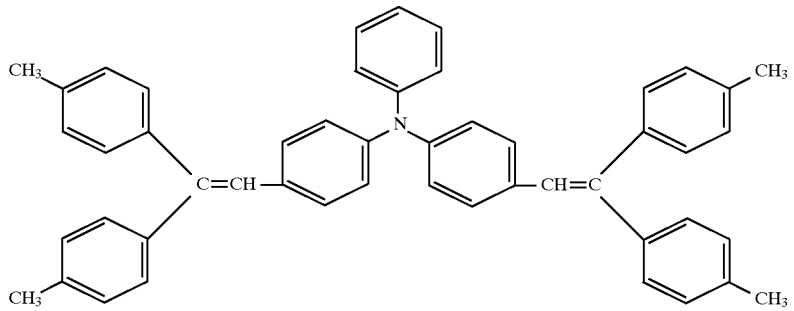

U-4

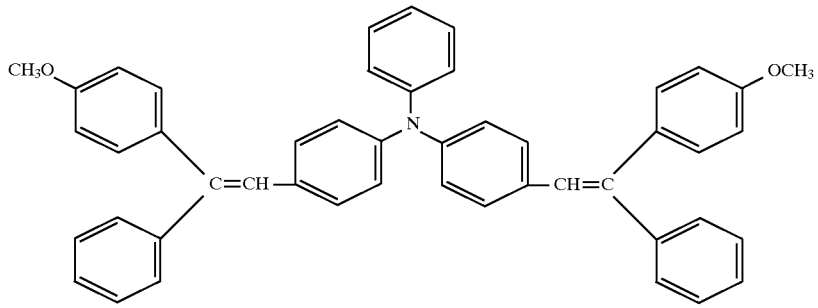

-continued
U-5
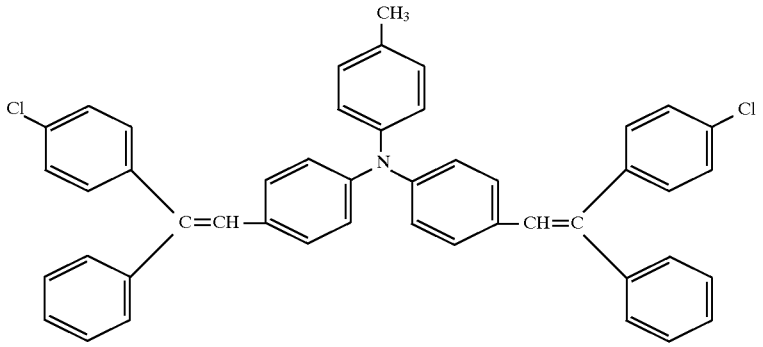
U-6
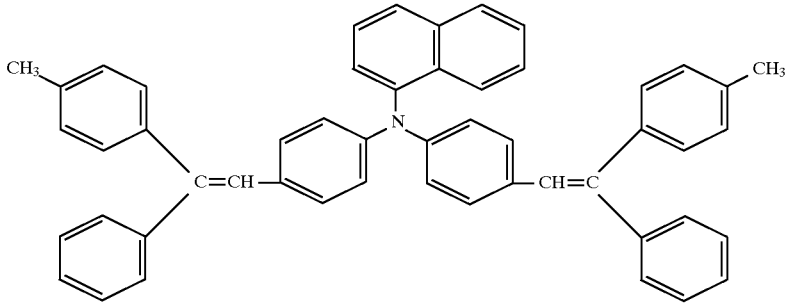
U-7
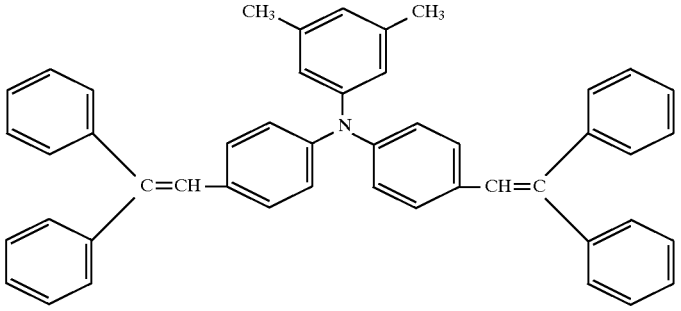
U-8
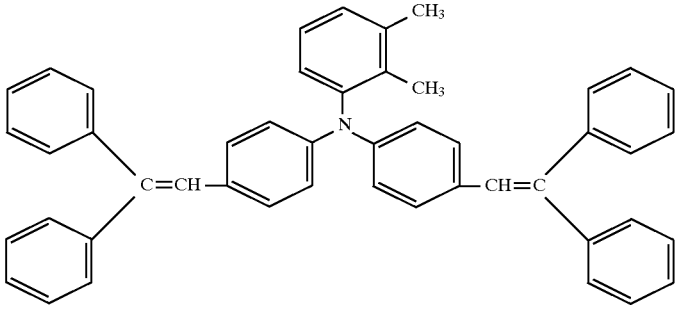
U-9
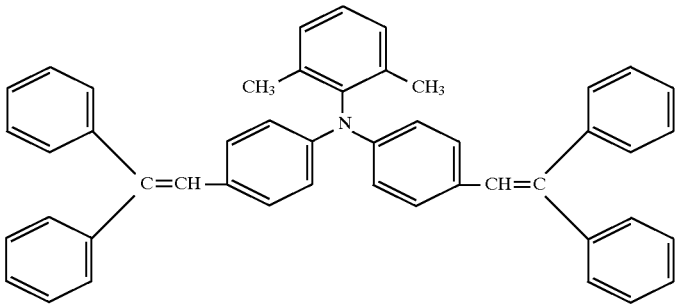

-continued
U-10
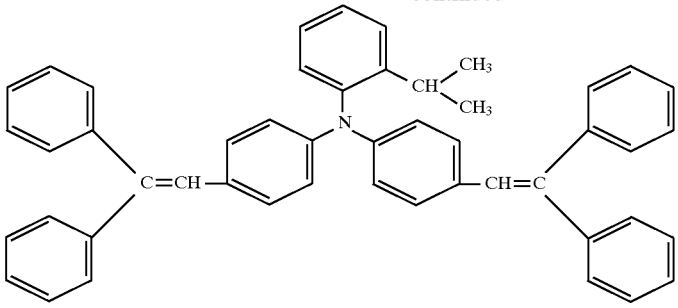
U-11
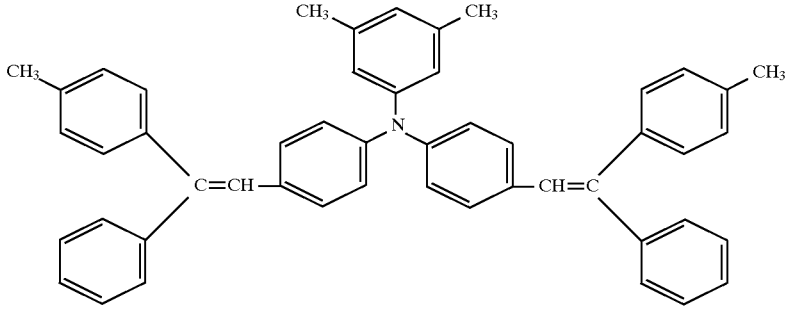
U-12
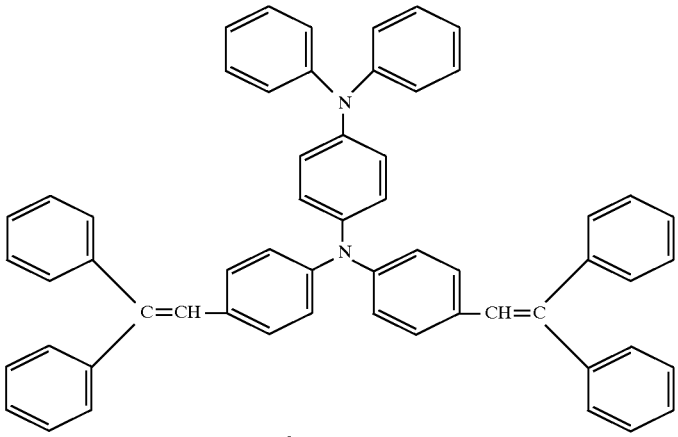
U-13
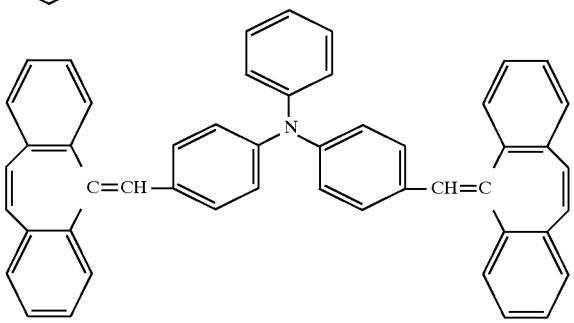
U-14
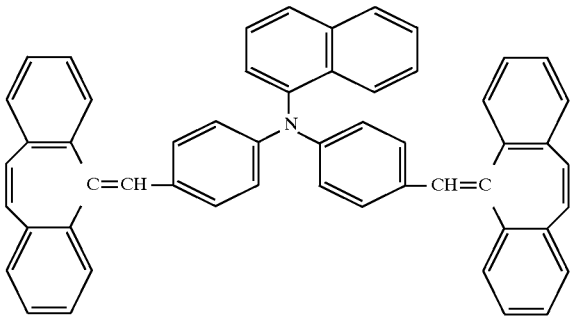

-continued
U-15
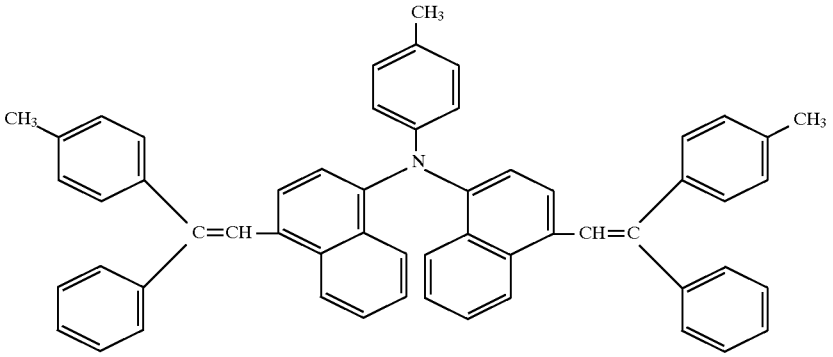
U-16
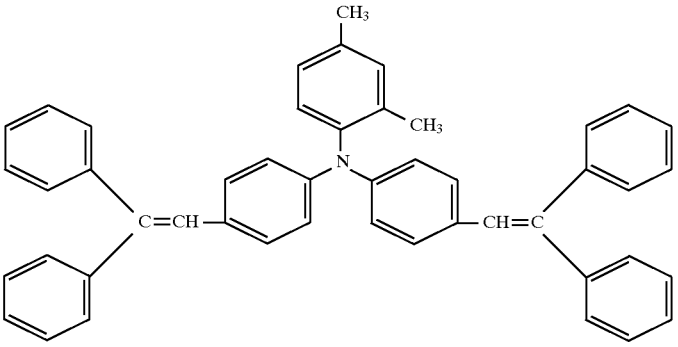
U-17
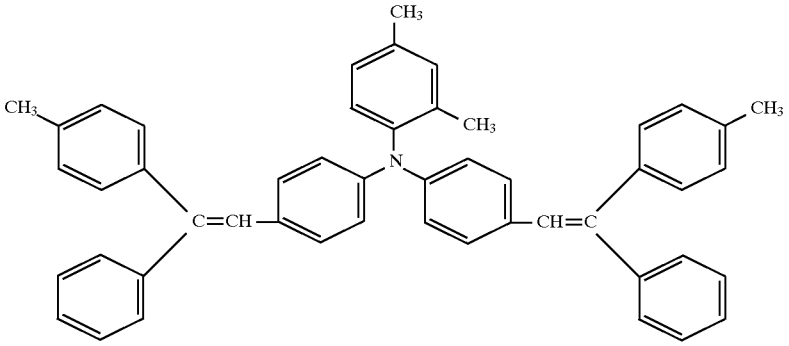
U-18
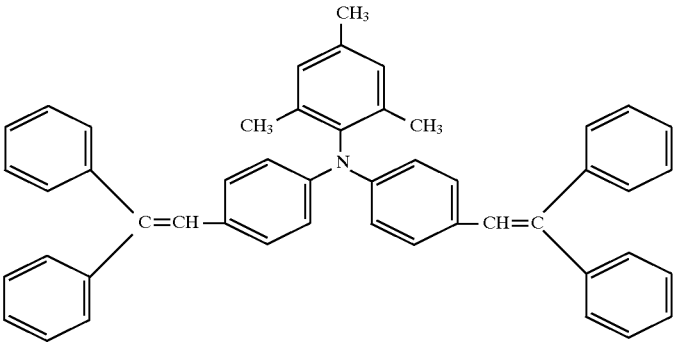

-continued

U-19

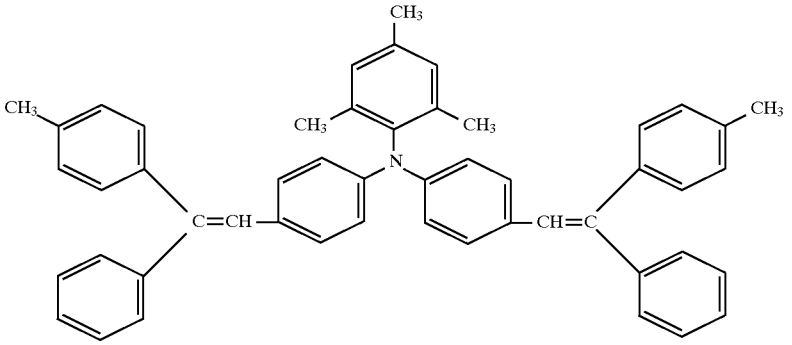

U-20

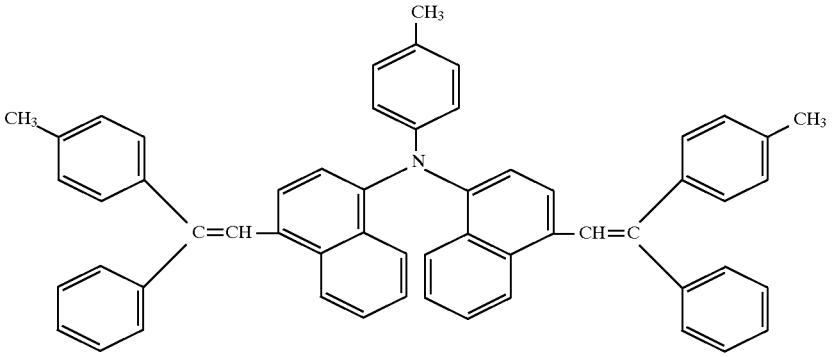

The invention can be used other CTM as long as they does not interfere with the desired action or effect. Examples of usable CTM include oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, amine derivatives, oxazolone derivatives, benzothiazole derivatives, benzimidazole derivatives, quinazoline derivatives, benzofuran derivatives, acridine derivatives, phenazine derivatives, aminostylbene derivatives, poly-N-vinylcarbazole, poly-1-vinylpyrene and poly-9-vinylanthracene.

This invention can be used various organic pigments as carrier generation material, for example azo pigments, perylene pigments polycyclic quinon pigments, indigoid pigments. It is preferable to use the organic pigments such as a fluorenone dis-azo pigment (U.S. Pat. No. 4,939,058), a polycyclic quinone pigment (U.S. Pat. No. 4,431,722), a perylene pigment (U.S. Pat. No. 3,972,717) or a phthalocyanine pigment (U.S. Pat. No. 4,898,799) as CGM.

In the present invention, compounds having in their molecular structure a hindered phenolic structural unit or a hindered amine structural unit can be used, and compounds having in their molecular structure a hindered phenolic structural unit are preferably used.

Compounds having in their molecular structure a hindered phenolic structural unit, used in the present invention, are described below. The amount of one of these compounds added is 0.1 to 100 parts by weight, preferably 1 to 50 parts by weight, and more preferably 5 to 25 parts by weight per 100 parts by weight of CTM. Typical examples thereof are those represented by the following formulas 1A, 2A, 3A, 4A and 5A.

In the present invention, Formula 1A and Formula 5A are preferably used.

Formula 1A

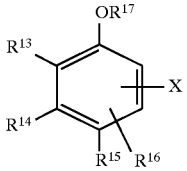

Formula 2A

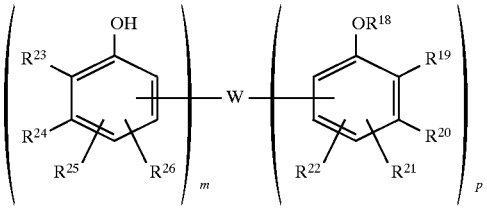

Formula 3A

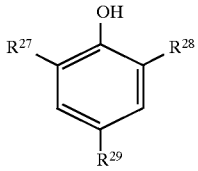

Formula 4A

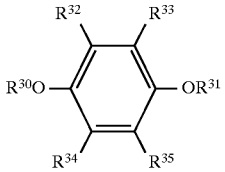

-continued

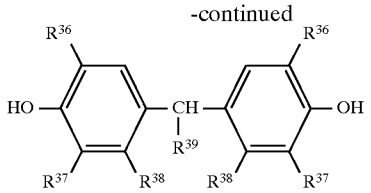

Formula 5A

With respect to formula 1A, $R^{13}$ represents a branched alkyl group; $R^{14}$, $R^{15}$ and $R^{16}$ independently represent a hydrogen atom, a hydroxy group, an alkyl group or an aryl group; $R^{15}$ and $R^{16}$ may bind together to form a ring; $R^{17}$ represents a hydrogen atom, an alkyl group or an alkylidene group.

The branched alkyl group for $R^{13}$ is preferably a tert- or sec-alkyl group having 3 to 40 carbon atoms.

The alkyl group for $R^{14}$, $R^{15}$ or $R^{16}$ is preferably one having 1 to 40 carbon atoms. The aryl group is preferably a phenyl group, a naphthyl group, a pyridyl group or the like.

When $R^{15}$ and $R^{16}$ form a ring, the ring is preferably a chroman ring.

The alkyl group or alkylidene group represented by $R^{17}$ is preferably one having 1 to 40 carbon atoms, more preferably 1 to 18 carbon atoms.

X represents a hydrogen atom or an organic residue, preferably an organic residue.

With respect to formula 2A, $R^{18}$ represents a hydrogen atom, an alkyl group, an aryl group or an aralkyl group; $R^{19}$ and $R^{23}$ independently represent a branched alkyl group; $R^{20}$, $R^{21}$, $R^{22}$, $R^{24}$, $R^{25}$ and $R^{26}$ independently represent a hydrogen atom or a substituent.

m and p independently represent 0 or a positive integer, with m+p being 2 to 4; W is a binding group.

The alkyl group represented by $R^{18}$ is an alkyl group having 1 to 40 carbon atoms, which may have a substituent. The substituent for $R^{18}$ is an aryl group, an alkoxy group, a carboxyl group, an amide group, a halogen atom or any other group.

The aralkyl group is a benzyl group, a phenethyl group or the like.

The branched alkyl group for $R^{19}$ or $R^{23}$ is one having 1 to 40 carbon atoms, such as a tert-butyl group, a sec-butyl group or a tert-octyl group.

Substituents for $R^{20}$ through $R^{22}$ and $R^{24}$ through $R^{26}$ include aryl groups, alkoxy groups, carboxyl groups, amide groups and halogen atoms.

The binding group W varies depending on the values for m and p. Typical examples of W include a methylene group, an ethylene group, a propylene group, a phenylene group, a sulfide group and a polysulfide group.

The above-described case includes direct binding of phenyl groups in the absence of W.

With respect to formula 3A, the alkyl group having 1 to 4 carbon atoms, represented by $R^{27}$, $R^{28}$ or $R^{29}$ may be linear or branched. Examples of such alkyl groups include a methyl group, an ethyl group, a propyl group, an isopropyl group, a butyl group, a sec-butyl group and a tert-butyl group.

Of these groups, a tert-butyl group is preferred. $R^{27}$, $R^{28}$ and $R^{29}$ may be identical or different.

With respect to formula 4A, $R^{30}$ and $R^{31}$ independently represent an alkyl group, an alkenyl group, a cycloalkyl group, an aryl group or a heterocyclic group; $R^{32}$, $R^{33}$, $R^{34}$ and $R^{35}$ independently represent a hydrogen atom, a halogen atom, an alkyl group, an alkenyl group, a cycloalkyl group, an aryl group, an alkoxy group, an alkylthio group, an aryloxy group, an arylthio group, an acyl group, an acylamino group, an alkylamino group, an alkoxycarbonyl group or a sulfonamide group.

With respect to formula 5A, $R^{36}$ represents an alkyl group having 1 to 18 carbon atoms; $R^{37}$ and $R^{38}$ independently represent a hydrogen atom or an alkyl group having 1 to 18 carbon atoms. $R^{39}$ represents a hydrogen atom or an alkyl group having 1 to 10 carbon atoms.

With respect to formula 5A, the alkyl group having 1 to 18 carbon atoms, represented by $R^{36}$, $R^{37}$ or $R^{38}$ may be linear or branched. Examples of such alkyl groups include a methyl group, an ethyl group, a propyl group, an isobutyl group, a tert-butyl group, a pentyl group, an octyl group and a dodecyl group.

The alkyl group having 1 to 10 carbon atoms, represented by $R^{39}$, may be linear or branched. Examples of such alkyl groups include a methyl group, an ethyl group, a propyl group, a butyl group, a tert-butyl group, a sec-pentyl group, a hexyl group and a nonyl group.

Of the compounds represented by the above formulas 1A through 5A, having in their molecular structure a hindered phenolic structural unit, the following are particularly important.

Example compounds

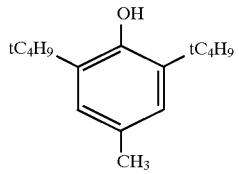

3A-1

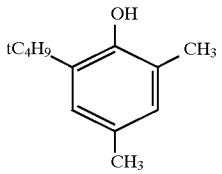

3A-2

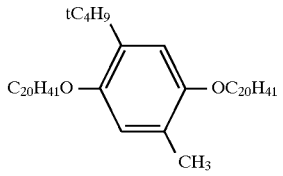

4A-1

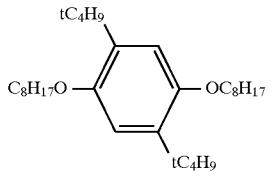

4A-2

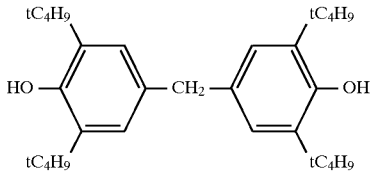

5A-1

Other examples of hindered phenolic compounds are given below.

(A)-1

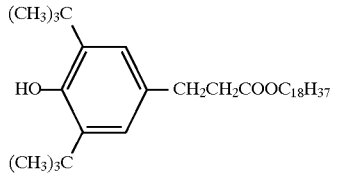

(A)-2

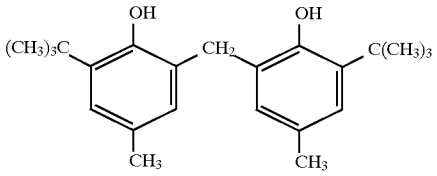

(A)-3

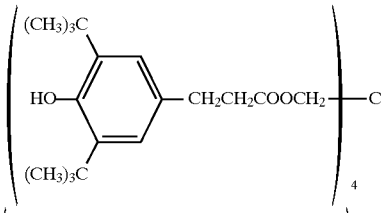

(A)-4

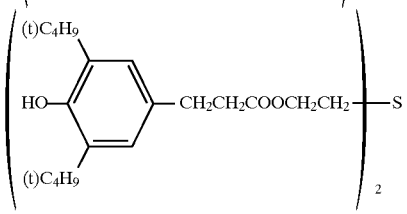

(A)-5

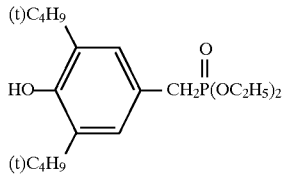

(A)-6

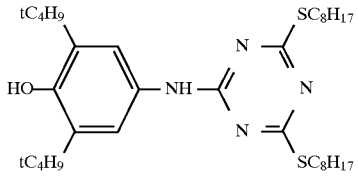

In the present invention, Compound (A)-3 is particularly preferable.

Compounds for the present invention, having in their molecular structure a hindered amine structural unit, are those represented by the following formulas 1B, 2B, 3B, 4B, 5B and 6B.

In the present invention, Formula 3B is preferably used.

Formula 1B

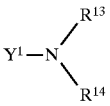

Formula 2B

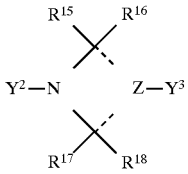

-continued

Formula 3B

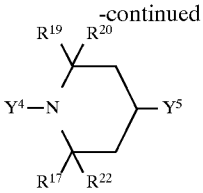

Formula 4B

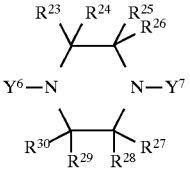

Formula 5B

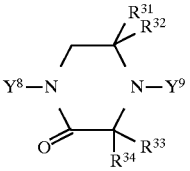

Formula 6B

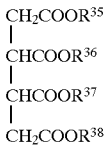

With respect to the above formulas 1B and 2B, $R^{13}$ and $R^{14}$ independently represent an alkyl group which may have a substituent, provided that either of $R^{13}$ and $R^{14}$ is a branched alkyl group.

$R^{15}$, $R^{16}$, $R^{17}$ and $R^{18}$ independently represent a hydrogen atom, an alkyl group or an aryl group, preferably an alkyl group having 1 to 40 atoms which may have a substituent.

The substituent for $R^{13}$ through $R^{18}$ may be an aryl group, an alkoxy group, a carboxyl group, an amide group, a halogen atom or any other substituent.

Z represents a group of atoms necessary to form a nitrogen-containing aliphatic ring, preferably a group of atoms forming a 5-or 6-membered ring. Preferable ring structures include piperidine, piperazine, morpholine, pyrrolidine, imidazolidine, oxazolidine, thiazolidine, selenazolidine, pyrroline, imidazoline, isoindoline, tetrahydroisoquinoline, tetrahydropyridine, dihydropyridine, dihydroisoquinoline, oxazoline, thiazoline, selenazoline and pyrrole, with preference given to rings of piperidine, piperazine and pyrrolidine.

One of the pair of $R^{15}$ and $R^{16}$ and one of the pair of $R^{17}$ and $R^{18}$ may be incorporated in Z while providing Z with a double bond.

$Y^1$ is an organic residue; $Y^2$ and $Y^3$ independently represent a hydrogen atom or an organic residue, preferably an organic residue.

With respect to the above formulas 3B, 4B, 5B and 6B, $R^{19}$ through $R^{34}$ independently represent a hydrogen atom or an alkyl group, which alkyl group preferably has 1 to 40 carbon atoms and may have a substituent such as an aryl group, an alkoxy group, an amide group or a halogen atom.

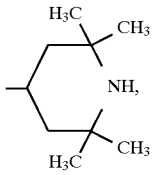
$R^{35}$ through $R^{38}$ independently represent
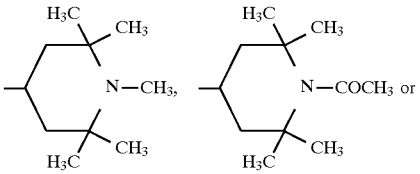
-continued
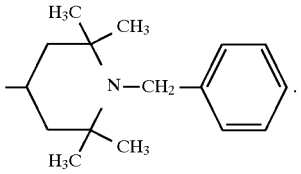
$Y^4$ through $Y^9$ independently represent a hydrogen atom or an organic residue, preferably an organic residue.
Of the compounds represented by the above formulas 1B through 6B, having in their molecular structure a hindered amine structural unit, the following are particularly important.
3B-1
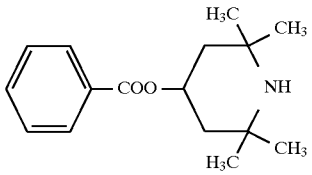
3B-2
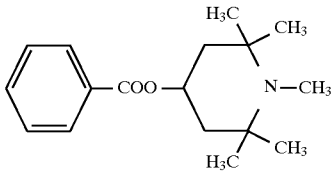
3B-3
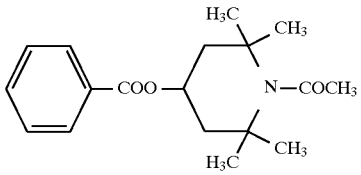
3B-4
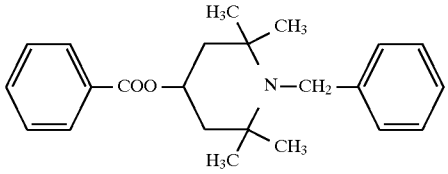
3B-5
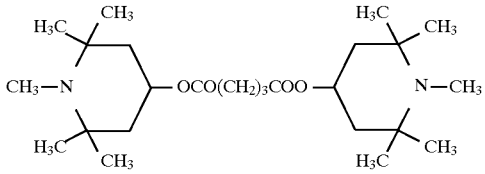
3B-6
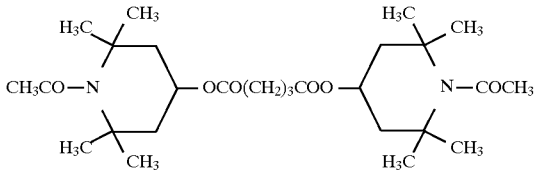

-continued
3B-7
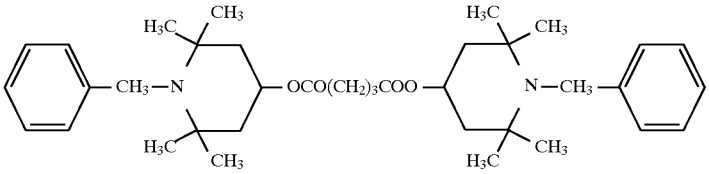
3B-8
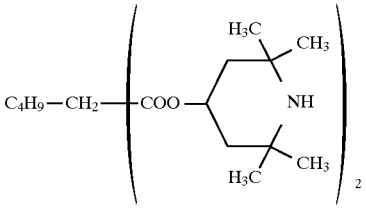
5B-1
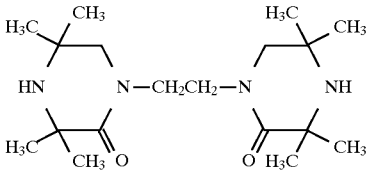
6B-1
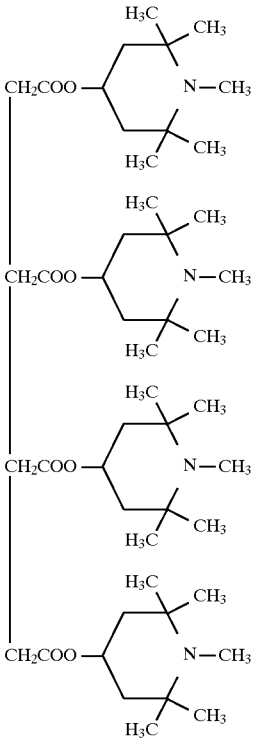

-continued 6B-2

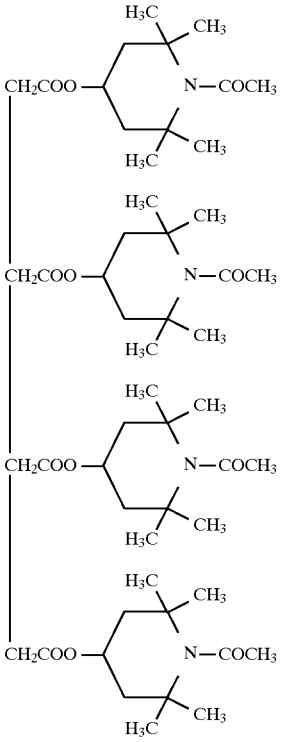

Among the compounds for the present invention, having in their molecular structure a copolymer component comprising a hindered phenolic structural unit and a hindered amine structural unit, there is compound C, comprising a copolymer of a hindered amine structural unit represented by the following formula 7B and a hindered phenolic structural unit represented by the following formula 6A.

Formula 7B

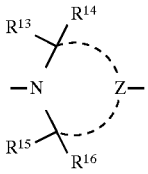

Formula 6A

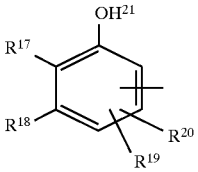

With respect to the above formulas 7B and 6A, $R^{13}$, $R^{14}$, $R^{15}$ and $R^{16}$ independently represent a hydrogen atom, an alkyl group or an aryl group; Z represents a group of atoms necessary to form a nitrogen-containing aliphatic ring. One of the pair of $R^{13}$ and $R^{14}$ and one of the pair of $R^{15}$ and $R^{16}$ may be incorporated in Z while providing Z with a double bond.

$R^{17}$ represents a branched alkyl group; $R^{18}$, $R^{19}$ and $R^{20}$ independently represent a hydrogen atom, a hydroxy group, an alkyl group or an aryl group; $R^{19}$ and $R^{20}$ may bind together to form a ring. $R^{21}$ represents a hydrogen atom, an alkyl group or an alkylidene group.

The above groups $R^{13}$, $R^{14}$, $R^{15}$ and $R^{16}$ are preferably alkyl groups having 1 to 40 carbon atoms and may have a substituent such as an aryl group, an alkoxy group, a carboxyl group, an amide group or a halogen atom.

Z represents a group of atoms necessary to form a nitrogen-containing aliphatic ring, preferably a group of atoms forming a 5-or 6-membered ring.

Preferable ring structures include piperidine, piperazine, morpholine, pyrrolidine, imidazolidine, oxazolidine, thiazolidine, selenazolidine, pyrroline, imidazoline, isoindoline, tetrahydroisoquinoline, tetrahydropyridine, dihydropyridine, dihydroisoquinoline, oxazoline, thiazoline, selenazoline and pyrrole, with preference given to rings of piperidine, piperazine and pyrrolidine.

The branched alkyl group $R^{11}$ is preferably a tert- or sec-alkyl group having 3 to 40 carbon atoms.

The alkyl group $R^{18}$, $R^{19}$ or $R^{20}$ is preferably one having 1 to 40 carbon atoms. The aryl group is preferably a phenyl group, a naphthyl group, a pyridyl group or the like.

When $R^{19}$ and $R^{20}$ form a ring, the ring is preferably a chroman ring.

The alkyl group or alkylidene group represented by $R^{21}$ is preferably one having 1 to 40 carbon atoms, more preferably 1 to 18 carbon atoms.

Of the compounds C comprising a copolymer of a hindered amine structural unit represented by the above formula 7B and a hindered phenolic structural unit represented by the above formula 6A, the following are important.

C-1
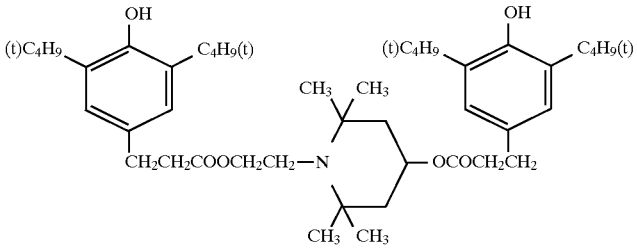
C-2
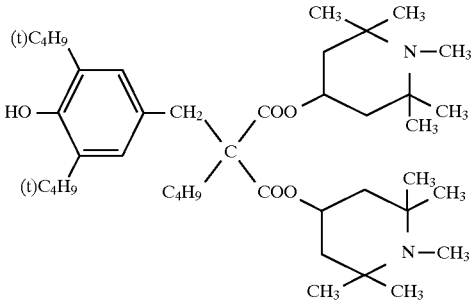
C-3
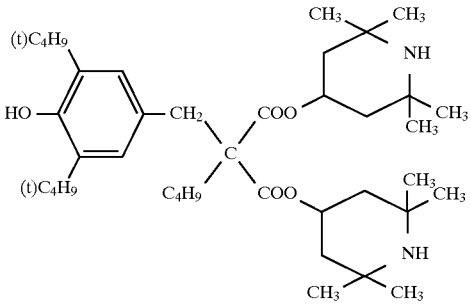
C-4
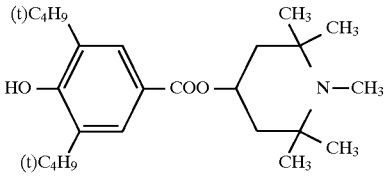
C-5
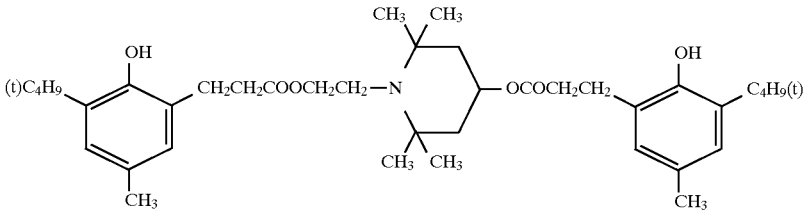
C-6
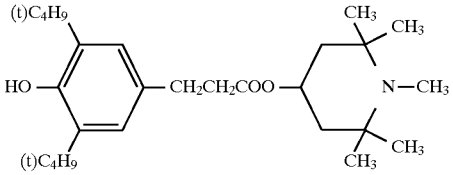
C-7
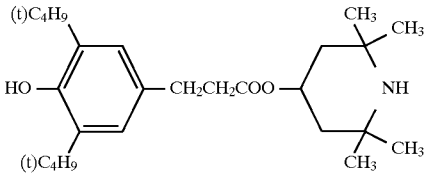

-continued

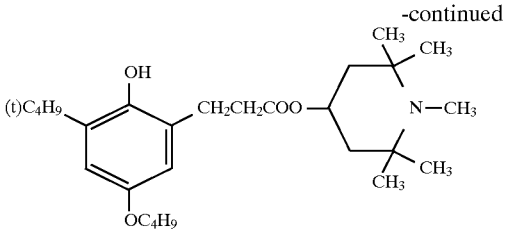

C-8

In the range of C-1 to C-8, C-1 is particularly preferably used.

Example dispersants for organic pigments for the present invention include, halogenated hydrocarbons such as methylene chloride, dichloroethane, ketones such as methyl ethyl ketone and cyclohexanone, esters such as butyl acetate, alcohols such as ethanol, propanol, butanol, ethers such as tetrahydrofuran, 1,4-dioxane.

In the present invention, for improving sensitivity, reducing residual potential, mitigating fatigue during repeated use and other purposes, the light-sensitive layer may incorporate one or more electron recipient substances.

Examples of electron recipients which can be used for these purposes include, maleic anhydride, chloranil, 2,4,7-trinitrofluorenone. The amount of electron recipient added is 0.01 to 200 parts by weight, preferably 0.1 to 100 parts by weight per 100 parts by weight of the organic pigment used for the invention.

The ratio of electron recipient added to such a light-sensitive layer is 0.01 to 100 parts by weight, preferably 0.1 to 50 parts by weight per 100 parts by weight of the total CTM composition.

The photoreceptor of the present invention may incorporate as necessary an ultraviolet absorbent and other additives to protect the light-sensitive layer, and may also incorporate a color sensitivity correcting dye.

The electrophotographic photoreceptor of the present invention may have as necessary an intermediate layer between the electrically conductive support and the light-sensitive layer.

The intermediate layer, which functions as an adhesive layer, blocking layer or another layer, may comprise polyvinyl alcohol, ethyl cellulose, carboxymethyl cellulose, vinyl chloride-vinyl acetate copolymer, vinyl chloride-vinyl acetate-maleic anhydride copolymer, casein, N-alkoxymethylated nylon, starch and other substances as well as the above-mentioned binder resins.

The electrically conductive support which constitutes the electrophotographic photoreceptor of the present invention is prepared mainly from the following substances, which are not to be construed as limitative.

1) Metal plates such as aluminum and stainless steel plates.

2) Paper or plastic film supports having a thin layer of a metal such as aluminum, palladium or gold formed thereon by lamination or evaporative deposition.

3) Paper or plastic film supports having a layer of an electrically conductive compound such as an electrically conductive polymer, indium oxide or tin oxide formed thereon by coating or evaporative deposition.

The photoreceptor of the present invention is prepared by forming a light-sensitive layer 4 on an electrically conductive support 1, which light-sensitive layer comprises a lamination of CGM-based CGL 2 and CTM-based CTL 3, as illustrated in FIGS. 1(*a*) and 1(*b*). As illustrated in FIGS. 1(*c*) and 1(*d*), the light-sensitive layer 4 may be formed via an intermediate layer 5 on an electrically conductive support 1. An electrophotographic photoreceptor with the best electrophotographic properties is obtained when light-sensitive layer 4 is configured with two layers as above. In the present invention, light-sensitive layer 4 wherein fine particles of CGM 7 are dispersed in binder resin in a CTM-based layer 6 may be formed on electrically conductive support 1 directly or via intermediate layer 5, as illustrated in FIGS. 1(*e*) and 1(*f*).

The light-sensitive layer 4 may be provided with a protective layer 8 formed thereon as necessary.

When light-sensitive layer 4 is of a double layer structure, it depends on carrier polarity which of CGL 2 and CTL 3 is to be located on the counterpart layer. To obtain a negatively charged light-sensitive layer, it is advantageous to locate CTL 3 on CGL 2. This is because the CTM in CTL 3 is highly capable of transporting positive holes.

CGL 2, constituting double-layered light-sensitive layer 4, can be prepared on electrically conductive support 1 or CTL 3 directly or via an adhesive layer, blocking layer or another intermediate layer formed as necessary as follows:

(1) Vacuum deposition.

(2) Coating a solution of CGM in an appropriate solvent.

(3) Coating a dispersion prepared by finely pulverizing a CGM in a dispersant using a ball mill, sand grinder or another means and, if necessary, mixing and dispersing with a binder.

Specifically, there can be used optionally vapor phase deposition methods such as vacuum deposition, sputtering and CVD, and coating methods such as dip coating, spray coating, blade coating and roll coating.

The binder content in this CTL 3 is preferably 0.1 to 5 parts by weight of binder per 1 part by weight of CTM 1 for the present invention, but when forming light-sensitive layer 4 containing fine grains of CGM dispersed therein, it is preferable to use the binder in a ratio of not more than 5 parts by weight per 1 part by weight of CGM.

When using CGL in dispersion in the binder, it is preferable to use the binder in the content ratio of not more than 5 parts by weight relative to 1 part by weight of CGM.

Configured as above, the photoreceptor of the present invention is excellent in chargeability, sensitivity and image forming capability, as is evident from the examples given below. The photoreceptor of the present invention is excellently durable with no fatigue deterioration even when applied to repeated transfer electrophotography.

EXAMPLES

The present invention is hereinafter described in more detail by means of the following examples, which are not to be construed as limitative on the embodiment of the invention.

Example 1

30 g of the polyamide resin CM-8000 (produced by Toray Industries, Inc.) was added to a mixture of 900 ml of methanol and 100 ml of 1- butanol and dissolved therein while heating at 50° C. Using this solution, an aluminum drum of 80 mm outside diameter and 355.5 mm length was dip-coated to yield an intermediate layer of 0.5 μm thickness.

Next, 5 g of the polyvinylbutyral resin Eslec BX-1 (produced by Sekisui Chemical Co., Ltd.) was dissolved in a mixture of 700 ml of methyl ethyl ketone and 300 ml of cyclohexanone, and 10 g of Example compound $F_1$-23, as CGM, was added, followed by dispersion for 10 hours using a sand mill. This dispersion was coated on the above intermediate layer by dip coating to form a carrier generation layer of 0.3 μm thickness.

Next, 200 g of T-2, as CTM, and 200 g of B-1 (x:y=80:20), as CTL binder, were dissolved in 1,000 ml of 1,2-dichloroethane. Using this solution, the above carrier generation layer was dip-coated, followed by drying at 100° C. for 1 hour, to yield a carrier transport layer of 20 μm thickness. A laminated photoreceptor comprising an intermediate layer, a carrier generation layer and a carrier transport layer was thus obtained.

Example 2

A laminated electrophotographic photoreceptor was obtained in the same manner as in Example 1 except that T-1 was used as CTM.

Example 3

A laminated electrophotographic photoreceptor was obtained in the same manner as in Example 1 except that T-4 was used as CTM.

Example 4

An intermediate layer was formed in the same manner as in Example 1.

Next, 10 g of the polyvinylbutyral resin Eslec BX-1 was dissolved in 1,000 ml of 1,2-dichloroethane, and 50 g of P-1, as CGM, was added, followed by dispersion for 20 hours using a sand mill. This dispersion was coated on the above intermediate layer by dip coating to form a carrier generation layer of 1.0 μm thickness.

Next, a carrier transport layer was formed in the same manner as in Example 1 except that T-17 was used as CTM and B-2 (x:y=75:25) used as CTL binder, to yield a laminated electrophotographic photoreceptor.

Example 5

An intermediate layer was formed in the same manner as in Example 1.

Next, 10 g of the polycarbonate resin Iupiron Z-200 (produced by Mitsubishi Gas Chemical Co., Inc.) was dissolved in 1,000 ml of 1,2-dichloroethane (produced by Kanto Chemical), and 20 g of $Q_1$-3, as CGM, was added, followed by dispersion for 24 hours using a sand mill. This dispersion was dip coated on the above intermediate layer to form a carrier generation layer of 1.0 μm thickness.

Next, a carrier transport layer was formed in the same manner as in Example 1 except that T-3 was used as CTM and B-7 (x:y=85:15) used as CTL binder, to yield a laminated electrophotographic photoreceptor.

Example 6

An intermediate layer was formed in the same manner as in Example 1.

Next, 100 g of the silicone resin KR-5240 (20% solid content, produced by Shin-Etsu Chemical) was dissolved in 1000 ml of methyl ethyl ketone, and 20 g of Y type oxytitanium phthalocyanine (Y-TiOPc) was added, followed by dispersion for 4 hours using a sand mill. This dispersion was dip coated on the above intermediate layer to form a carrier generation layer of 0.5 μm thickness.

Next, a carrier transport layer was formed in the same manner as in Example 1 except that T-5 was used as CTM and B-12 (x:y=70:30) as CTL binder, to yield a laminated electrophotographic photoreceptor.

Example 7

200 g of T-25, as CTM, and 200 g of B-5 (x:y=80:20), as CTL binder, were dissolved in 1,000 ml of 1,2-dichloroethane. Using this solution, an aluminum drum of 80 mm outside diameter and 355.5 mm length was dip-coated, followed by drying at 100° C. for 1 hour, to yield a carrier transport layer of 20 μm thickness.

Next, 200 g of B-5 (x:y=80:20), as CGL binder, was dissolved in 1,000 ml of 1,2-dichloroethane, and 60 g of $Q_1$-3, as CGM, was added, followed by dispersion for 24 hours using a sand mill. In this dispersion was dissolved 150 g of T-25, as CTM, to yield a coating solution. Using this solution, the above carrier transport layer was spray coated, followed by drying at 100° C. for 1 hour, to yield a carrier generation layer of 5 μm thickness. A laminated photoreceptor comprising an intermediate layer, a carrier generation layer and a carrier transport layer was thus obtained.

Comparative Example 1

An electrophotographic photoreceptor was obtained in the same manner as in Example 1 except that $B_1$-1 was used as CTL binder.

Comparative Example 2

An electrophotographic photoreceptor was obtained in the same manner as in Example 1 except that $B_1$-7 was used as CTL binder.

Comparative Example 3

An electrophotographic photoreceptor was prepared in the same manner as in Example 1 except that C-1 was used as CTL.

C-1

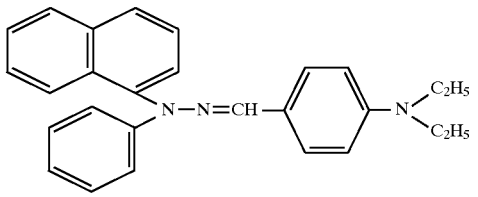

Example 8

An electrophotographic photoreceptor was prepared in the same manner as in Example 1 except that 200 g of U-17 was used as CTM instead of T-2.

Example 9

A laminated electrophotographic photoreceptor was obtained in the same manner as in Example 1 except that U-18 was used as CTM.

Example 10

A laminated electrophotographic photoreceptor was obtained in the same manner as in Example 1 except that U-9 was used as CTM.

Example 11

An electrophotographic photoreceptor was prepared in the same manner as in Example 4 except that U-13 was used as CTM instead of T-17.

Example 12

An electrophotographic photoreceptor was prepared in the same manner as in Example 5 except that U-19 was used as CTM instead of T-3.

Example 13

An electrophotographic photoreceptor was prepared in the same manner as in Example 6 except that U-3 was used as CTM instead of T-5.

Example 14

An electrophotographic photoreceptor was prepared in the same manner as in Example 7 except 200 g of U-11 was used as CTM instead of T-25.

Comparative Example 4

An electrophotographic photoreceptor was obtained in the same manner as in Example 8 except that $B_1$-1 was used as CTL binder.

Comparative Example 5

An electrophotographic photoreceptor was obtained in the same manner as in Example 8 except that $B_1$-7 was used as CTL binder.

Comparative Example 6

An electrophotographic photoreceptor was prepared in the same manner as in Example 8 except that C-1 represented by the following structural formula was used as CTL.

C-1

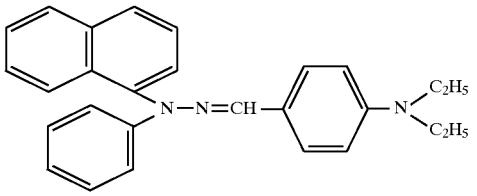

Performance evaluation of photoreceptors

Each of the photoreceptors obtained in Examples 1 through 14 and Comparative Examples 1 through 6 was used to take 100000 copies on U-Bix 3035 (produced by Konica Corporation). In this actual copying test, imaging failures during the test and changes in surface potential of the photoreceptors and film wear after the test were examined and evaluated.

Black paper potential $V_b$: Surface potential for an original of a reflex density of 1.3.

White paper potential $V_w$: Surface potential for an original of a reflex density of 0.0.

Residual potential $V_r$: Surface potential after discharging.

The same actual copying test was conducted using the photoreceptor of Example 6, 13 on a modification of U-Bix 3035 (produced by Konica Corporation) (equipped with a semiconductor laser beam source), wherein the grid voltage was adjusted to obtain a $V_b$ of −700±10 V, the exposure surface potential for 0.7 mW light irradiation was set at $V_w$, and reversal developing was carried out at a developing bias of −600 V.

The same actual copying test was conducted using the photoreceptor of Example 7, 14 on a modification of U-Bix 3035 (produced by Konica Corporation), wherein carrier and transfer polarity was changed to positive.

To evaluate film wear due to surface friction, the film thickness of the photoreceptor after 100000 copies was compared with the initial value.

Concerning cracking, the photoreceptor was set on a drum cartridge of U-Bix 3035 (produced by Konica Corporation), and kept standing in a constant temperature chamber at 50° C. for 1000 hours while keeping the cleaning roller pressed against the photoreceptor, and constantly examined for cracking.

The results are given in Tables 2 and 3.

TABLE 2

| | | | | Photoreceptor surface potential (V) | | | | | | | | |
|---|---|---|---|---|---|---|---|---|---|---|---|---|
| | | | | Initial | | | After 100000 copies | | | Film wear | | |
| No. | CGM | CTM | CTL binder | Vb | Vw | Vr | Vb | Vw | Vr | (μm) | Image quality | Cracking |
| Example 1 | $F_1$-23 | T-2 | B-1 x:y = 80:20 | −720 | −40 | −10 | −710 | −85 | −50 | 1.4 | Good | None |
| Example 2 | $F_1$-23 | T-1 | B-1 x:y = 80:20 | −715 | −45 | −15 | −705 | −90 | −45 | 1.4 | Good | None |
| Example 3 | $F_1$-23 | T-24 | B-1 x:y = 80:20 | −705 | −40 | −10 | −705 | −90 | −50 | 1.5 | Good | None |
| Example 4 | P-1 | T-17 | B-2 x:y = 75:25 | −720 | −55 | −10 | −700 | −95 | −40 | 1.6 | Good | None |
| Example 5 | $Q_1$-3 | T-3 | B-7 x:y = 85:15 | −710 | −50 | −10 | −700 | −100 | −45 | 1.8 | Good | None |
| Example 6 | Y-TiOPc | T-5 | B-12 x:y = 70:30 | −700 | −50 | −15 | −695 | −95 | −45 | 1.8 | Good | None |

TABLE 2-continued

| | | | | Photoreceptor surface potential (V) | | | | | | | | |
|---|---|---|---|---|---|---|---|---|---|---|---|---|
| | | | | Initial | | | After 100000 copies | | | Film wear | | |
| No. | CGM | CTM | CTL binder | Vb | Vw | Vr | Vb | Vw | Vr | (μm) | Image quality | Cracking |
| Example 7 | $Q_1$-23 | T-25 | B-5 x:y = 80:20 (The same applies to CGL binder.) | +710 | +60 | +10 | +700 | +100 | +50 | 2.0 | Good | None |
| Comparative Example 1 | $F_1$-23 | T-2 | $B_1$-1 | −715 | −75 | −20 | −680 | −125 | −70 | 7.0 | Streaks appeared in half-tone area after 40000 copies; cleaning failure after 80000 copies | Cracking occurred in cleaning roller portion after 340 hours |
| Comparative Example 2 | $F_1$-23 | T-2 | $B_1$-7 | −720 | −70 | −15 | −690 | −120 | −65 | 4.0 | Streaks appeared in half-tone area after 80000 copies | Cracking occurred in cleaning roller portion after 170 hours |
| Comparative Example 3 | $F_1$-23 | Hydra-zone | B-1 x:y = 80:20 | −720 | −60 | −20 | −710 | −200 | −110 | 1.6 | Fogging occurred after 80000 copies | None |

TABLE 3

| | | | | Photoreceptor surface potential (V) | | | | | | | | |
|---|---|---|---|---|---|---|---|---|---|---|---|---|
| | | | | Initial | | | After 100000 copies | | | Film wear | | |
| No. | CGM | CTM | CTL binder | Vb | Vw | Vr | Vb | Vw | Vr | (μm) | Image quality | Cracking |
| Example 8 | $F_1$-23 | U-17 | B-1 x:y = 80:20 | −710 | −35 | −10 | −705 | −80 | −45 | 1.6 | Good | None |
| Example 9 | $F_1$-23 | U-18 | B-1 x:y = 80:20 | −715 | −40 | −15 | −710 | −85 | −50 | 1.4 | Good | None |
| Example 10 | $F_1$-23 | U-9 | B-1 x:y = 80:20 | −715 | −40 | −15 | −705 | −80 | −55 | 1.6 | Good | None |
| Example 11 | P-1 | U-13 | B-2 x:y = 75:25 | −720 | −45 | −15 | −710 | −90 | −45 | 1.8 | Good | None |
| Example 12 | $Q_1$-3 | U-19 | B-7 x:y = 85:15 | −720 | −50 | −20 | −715 | −95 | −55 | 2.0 | Good | None |
| Example 13 | Y-TioPc | U-3 | B-12 x:y = 70:30 | −710 | −50 | −15 | −700 | −80 | −50 | 2.0 | Good | None |
| Example 14 | $Q_1$-3 | U-11 | B-5 x:y = 80:20 (The same applies to CGL binder.) | +705 | +45 | +20 | +695 | +95 | +55 | 2.0 | Good | None |
| Comparative Example 4 | $F_1$-23 | U-17 | $B_1$-1 | −710 | −70 | −15 | −680 | −115 | −60 | 7.5 | Streaks appeared in half-tone area after 40000 copies; cleaning failure after 80000 copies | Cracking occurred in cleaning roller portion after 240 hours |
| Comparative Example 5 | $F_1$-23 | U-17 | $B_1$-7 | −705 | −65 | −15 | −680 | −110 | −55 | 5.5 | Streaks appeared in half-tone area after 60000 copies | Cracking occurred in cleaning roller portion after 110 hours |
| Comparative Example 6 | $F_1$-23 | Hydra-zone | B-1 x:y = 80:20 | −720 | −60 | −20 | −710 | −200 | −110 | 1.6 | Fogging occurred after 80000 copies | None |

As seen in Table 2, the photoreceptors according to the present invention surpass the comparative photoreceptors.

Example 15

A intermediate layer was formed in the same manner as in Example 1.

Next, 5 g of the polyvinylbutyral resin Eslec BX-1 was dissolved in 1,000 ml of methyl ethyl ketone, and 10 g of carrier generation material (CGM) $Q_1$-3, was added, followed by dispersion for 20 hours using a sand mill. This dispersion was coated on the above intermediate layer by dip coating to form a 0.5 μm-thick carrier generation layer (CGL). Next, 200 g of Example Compound carrier transport material (CTM) T-24, 5 g of Example antioxidant phenolic AO agent 3A-1 and 200 g of copolymer compound B-1 were dissolved in 1,000 ml of dichloromethane. The resulting solution was dip-coated on the above CGL to yield a 20 μm-thick carrier transport layer (CTL), followed by heating at 100° C. for 1 hour, to yield a photoreceptor of the present invention.

Examples 16 through 24

Nine electrophotographic photoreceptors of Examples 16 through 24 were obtained in the same manner as in Example 15 except that the kinds of CGM, CTM, binder resin and AO agent were changed as shown in Table 4.

Comparative Examples 7 through 10

Four electrophotographic photoreceptors of Comparative Examples 7 through 10 were obtained in the same manner as in Example 15 except that the kinds of binder resin and AO agent hanged as shown in Table 5.

TABLE 4

| Example | CGM | CTM | Copolymer compound | AO agent |
|---|---|---|---|---|
| 15 | $Q_1$-3 | T-24 | B-1 (x:y = 80:20) | 3A-1 |
| 16 | $Q_1$-3 | T-1 | B-2 (x:y = 80:20) | (A)-3 |
| 17 | $F_1$-23 | U-17 | B-7 (x:y = 85:15) | (A)-4 |
| 18 | F-1 | T-1 | B-1 (x:y = 80:20) | (A)-5 |
| 19 | $F_1$-23 | T-17 | B-1 (x:y = 80:20) | (A)-1 |
| 20 | $F_1$-23 | U-17 | B-1 (x:y = 80:20) | (A)-6 |
| 21 | P-1 | U-1 | B-1 (x:y = 80:20) | 3B-1 |
| 22 | P-1 | T-2 | B-1 (x:y = 80:20) | 3B-6 |
| 23 | Y-TiOPc | U-7 | B-1 (x:y = 80:20) | C-7 |
| 24 | F-1 | T-24 | B-1 (x:y = 80:20) | C-4 |
| 25 | $Q_1$-3 | T-24 | B-1 (x:y = 80:20) | 3A-1 |

TABLE 5

| Comparative Example | CGM | CTM | Polymer compound | AO agent |
|---|---|---|---|---|
| 7 | $Q_1$-3 | T-24 | BPA | (A)-3 |
| 8 | $F_1$-23 | T-1 | BPZ | (A)-3 |
| 9 | F-1 | T-17 | B-1 (x:y = 80:20) | — |
| 10 | $F_1$-23 | U-1 | B-1 (x:y = 80:20) | *Phosphorus compound |
| 11 | $Q_1$-3 | T-24 | B-1 (x:y = 80:20) | *Phosphorus compound |

* = Trinonylphenoxyphosphine

Example 25

On an intermediate layer formed in the same manner as in Example 15, a solution, in 1,000 ml of dichloromethane, of 200 g of T-24, 10 g of Example compound phenolic AO agent 3A-1 and 200 g of bisphenol A type polycarbonate Panlite L-1250 (produced by Teijin Chemicals, Ltd.), was dip coated to yield a CTL of 18 $\mu$m thickness. Next, 5 g of binder resin B-1, 3 g of T-24, as CTM, and 0.5 g of Example compound phenolic AO agent 3A-1 were dissolved in 1,000 ml of the solvent dichloroethane, and 3 g of $Q_1$-3, as CGM, was added, followed by dispersion for 20 hours using a sand mill. The resulting dispersion was coated on the above CTL using a circular slide hopper to yield a CGL of 3 $\mu$m thickness, followed by drying at 100° C. for 1 hour, to yield a electrophotographic photoreceptor of the present invention.

Comparative Example 11

A comparative photoreceptor was obtained in the same manner as in Example 25 except that trinonylphenoxyphosphine AO agent was used in place of the AO agent 3A-1 in CTL and CGL.

Each of the photoreceptors thus obtained in the above Examples and Comparative Examples was used to take 100000 copies on U-Bix 3035 (produced by Konica Corporation). In this actual copying test, cracking during the test and imaging failures were examined macroscopically. The developing apparatus was removed, and a potential probe was arranged instead, and determinations were made of black paper potential $V_b$, white paper potential $V_w$ and residual potential $V_r$ initially and after 100000 copies. The results are given in Table 6.

For the electrophotographic photoreceptors of Example 25 and Comparative Example 11, charging and transfer polarity was changed from negative to positive, and the positive toner developing agent was replaced with a negative toner developing agent.

Here, black paper potential is defined as the surface potential of the photoreceptor after the above copying cycle on a black paper original of a reflex density of 1.3, while white paper potential is defined as the surface potential of the photoreceptor after the above copying cycle on a white paper original.

The results are given in Table 6 below.

TABLE 6

| Property Example or Comparative Example | Photoreceptor surface potential | | | | | | |
|---|---|---|---|---|---|---|---|
| | Before copying | | | After copying | | | |
| | Vb | Vw | Vr | Vb | Vw | Vr | Image quality |
| Example 15 | −720 | −45 | −5 | −715 | −90 | −55 | Good |
| Example 16 | −720 | −35 | 0 | −725 | −85 | −60 | Good |
| Example 17 | −725 | −50 | −10 | −705 | −75 | −30 | Good |
| Example 18 | −710 | −40 | −5 | −710 | −80 | −45 | Good |
| Example 19 | −715 | −45 | 0 | −725 | −85 | −30 | Good |
| Example 20 | −720 | −60 | 0 | −730 | −80 | −40 | Good |
| Example 21 | −725 | −55 | −10 | −705 | −90 | −55 | Good |
| Example 22 | −730 | −50 | −5 | −710 | −85 | −40 | Good |
| Example 23 | −695 | −55 | −5 | −715 | −70 | −45 | Good |
| Example 24 | −700 | −40 | −15 | −690 | −65 | −50 | Good |
| Comparative Example 7 | −710 | −35 | −15 | −730 | −220 | −75 | Fogging occurred after 40000 copies |
| Comparative Example 8 | −725 | −30 | −10 | −740 | −160 | −70 | Fogging occurred after 70000 copies |
| Comparative Example 9 | −690 | −45 | −10 | −720 | −170 | −135 | Fogging occurred after 60000 copies |
| Comparative Example 10 | −720 | −50 | ±0 | −745 | −280 | −185 | Fogging occurred after 20000 copies |
| Example 25 | +720 | +60 | +10 | +710 | +95 | +30 | No fogging |
| Comparative Example 11 | +710 | +80 | +15 | +695 | +185 | +120 | Fogging occurred after 50000 copies |

As seen in Table 6, the electrophotographic photoreceptors of Examples showed minor reduction in potential and residual potential during actual copying, with little fatigue deterioration even after 100000 cycles of charging and exposure, while the electrophotographic photoreceptors of Comparative Examples showed considerable fatigue deterioration.

It is also seen that constantly high image quality was obtained in Examples while fogging etc. hampered the obtainment of good images after a few dozen thousand copies were taken.

Example 26

On the surface of an electrically conductive aluminum drum support of 60 mm diameter, a solution, in 100 parts by weight of cyclohexanone, of 1 part by weight of vinyl chloride-vinyl acetate-maleic anhydride copolymer Eslec MF-10 (produced by Sekisui Chemical) was coated to yield a 0.1 μm-thick intermediate layer. Next, 1 part by weight of the dibromoanthanthrone Monolite Red 2Y and 30 parts by weight of 1,2-dichloroethane, as carrier generation materials, were added, followed by dispersion for 24 hours using a ball mill. In the resulting dispersion was dissolved 1.5 parts by weight of the polycarbonate resin Panlite L-1250 (produced by Teijin Chemicals, Ltd.), and this solution was coated on the above intermediate layer to yield a CGL having a dry film thickness of 1 μm.

On the above CGL, a solution of 6 parts by weight of the following styryl compound in a mixture of 90 parts by weight of 1,2-dichloroethane and 10 parts by weight of the inventive compound B-1 (x:y=80:20) was coated to yield a CTL having a dry film thickness of 20 μm, whereby a photoreceptor of negatively chargeable double layer structure was obtained.

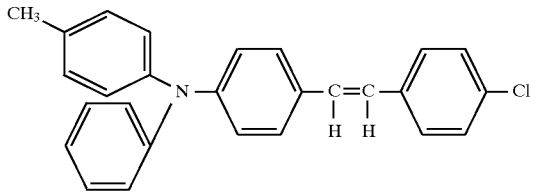

This photoreceptor was named inventive electrophotographic photoreceptor P1.

Next, other inventive electrophotographic photoreceptors P2 and P3 were prepared in the same manner as with the above electrophotographic photoreceptor P1 except that compound B-2 (x:y=75:25) or compound B-7 (x:y=85:15), as binder resin for the present invention, was used in CTL.

Next, comparative electrophotographic photoreceptors Q1 and Q2 were prepared in the same manner as the above electrophotographic photoreceptor P1 except that the polycarbonate resin Panlite L-1250 (produced by Teijin Chemicals, Ltd., bisphenol A type) or the polycarbonate resin Iupiron Z-200 (produced by Mitsubishi Gas Chemical Co., Inc., bisphenol Z type) was used as binder resin for CTL.

The above electrophotographic photoreceptors P1, P2 and P3 were tested as follows:

Inventive Test Nos. 1 through 6

As shown in Table 2 for Test Nos. 1 through 6, each of the above electrophotographic photoreceptors was used to take 60000 copies on U-Bix 1020 under ambient conditions of 20° C. and 50% RH while keeping a polyurethane cleaning blade of 70° hardness in contact with the electrophotographic photoreceptor under a pressure load of 10 g/cm or 20 g/cm at the position shown in FIG. 2, and light-sensitive layer wear loss (μm) was measured. The results are given in Table 7. The developing apparatus was removed, and a potential probe was arranged instead, and determinations were made of black paper potential $V_b$, white paper potential $V_w$ and residual potential $V_r$ initially and after 60000 copies. The results are given in Table 7.

Here, black paper potential is defined as the surface potential of the photoreceptor after the above copying cycle on a black paper original of a reflex density of 1.3, while white paper potential is defined as the surface potential of the photoreceptor after the above copying cycle on a white paper original.

Comparative Test Nos. 1 through 4

An actual copying test and an electrostatic property test were conducted in the same manner as in the above Tests except that comparative electrophotographic photoreceptors Q1 and Q2 were used. The results are given in Table 7.

TABLE 7

| | | | | Photoreceptor surface potential | | | | | | |
|---|---|---|---|---|---|---|---|---|---|---|
| | | Electrophotographic | Blade | Before copying | | | After 60000 copies | | | Wear loss |
| Test No. | Property | photoreceptor | load | Vb | Vw | Vr | Vb | Vw | Vr | (μm) |
| Inventive | 1 | P1 | 10 g/cm | −750 | −60 | −5 | −740 | −70 | −10 | 1.1 |
| Inventive | 2 | P1 | 20 g/cm | −750 | −60 | −5 | −730 | −80 | −10 | 2.4 |
| Inventive | 3 | P2 | 10 g/cm | −735 | −75 | −10 | −720 | −90 | −20 | 1.3 |
| Inventive | 4 | P2 | 20 g/cm | −735 | −75 | −10 | −705 | −105 | −20 | 2.8 |
| Inventive | 5 | P3 | 10 g/cm | −720 | −85 | −10 | −705 | −100 | −20 | 1.6 |
| Inventive | 6 | P3 | 20 g/cm | −720 | −85 | −10 | −690 | −115 | −20 | 3.5 |
| Comparative | 1 | Q1 | 10 g/cm | −740 | −70 | −10 | −710 | −100 | −20 | 3.6 |
| Comparative | 2 | Q1 | 20 g/cm | −740 | −70 | −10 | −620 | −210 | −40 | 8.1 |
| Comparative | 3 | Q2 | 10 g/cm | −750 | −65 | −5 | −730 | −85 | −15 | 2.1 |
| Comparative | 4 | Q2 | 20 g/cm | −750 | −65 | −5 | −700 | −130 | −20 | 4.5 |

As seen in Table 7, the electrophotographic photoreceptors according to the present invention surpass the comparative electrophotographic photoreceptors.

Example 27

Each of the photoreceptors of Example 26, P1, P2, P3, Q1 and Q2 was attached to a U-Bix 1020 drum cartridge and stored in a constant temperature/humidity chamber at 50° C. and 20% RH for 3 months, followed by an image forming test to visually inspect cracking. The results are given in Table 8.

TABLE 8

| Test No. | Property | Electrophotographic photoreceptor | Blade load | Cracking after storage test |
|---|---|---|---|---|
| Inventive | 7 | P1 | 20 g/cm | No cracking after 90 days |

TABLE 8-continued

| Test No. | Property | Electro-photographic photoreceptor | Blade load | Cracking after storage test |
|---|---|---|---|---|
| Inventive | 8 | P2 | 20 g/cm | No cracking after 90 days |
| Inventive | 9 | P3 | 20 g/cm | No cracking after 90 days |
| Inventive | 10 | P1 | 10 g/cm | No cracking after 90 days |
| Inventive | 11 | P2 | 10 g/cm | No cracking after 90 days |
| Comparative | 5 | Q1 | 20 g/cm | Cracking occurred after 60 days |
| Comparative | 6 | Q2 | 20 g/cm | Cracking occurred after 20 days |
| Comparative | 7 | Q1 | 10 g/cm | Cracking occurred after 40 days |
| Comparative | 8 | Q2 | 10 g/cm | Cracking occurred after 15 days |

As seen in Table 8, the electrophotographic photoreceptors according to the present invention surpass the comparative electrophotographic photoreceptors.

What is claimed is:

1. An electrophotographic photoreceptor comprising an electrically conductive support having provided thereon a light-sensitive layer comprising a copolymer having a structural unit represented by each of Formula $B_1$ and Formula $B_2$, said photoreceptor further comprising a compound selected from the group consisting of compounds having a hindered phenolic unit and compounds having a hindered amine unit;

Formula $B_1$

Formula $B_2$

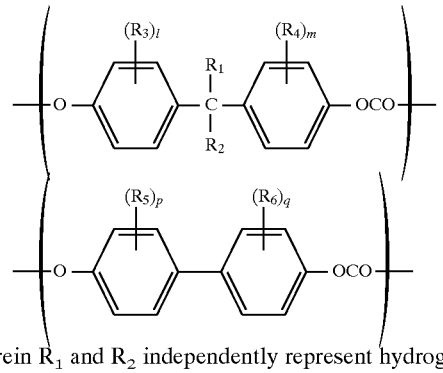

wherein $R_1$ and $R_2$ independently represent hydrogen, alkyl having 1 to 6 carbon atoms, or aryl, $R_1$ and $R_2$ may combine together to form a cyclic hydrocarbon residue having 4 to 10 carbon atoms, $R_3$, $R_4$, $R_5$ and $R_6$ independently represent hydrogen, halogen, alkyl having 1 to 6 carbon atoms, or aryl, l, m, p, and q independently represent an integer of 1 to 4.

2. The electrophotographic photoreceptor of claim 1, wherein said light-sensitive material further comprises a carrier transport material represented by Formula T.

3. The electrophotographic photoreceptor of claim 1, wherein said Formula $B_1$ is Formula B:

Formula B

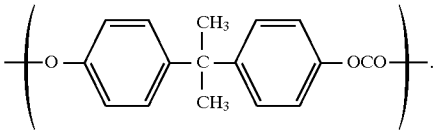

4. The electrophotographic photoreceptor of claim 1, wherein said Formula $B_2$ is Formula C:

Formula C

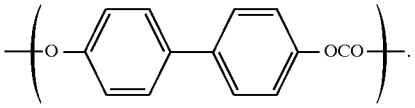

5. The electrophotographic photoreceptor of claim 1, wherein said compound having a hindered phenolic unit is selected from the group consisting of Formula 1A, Formula 2A, Formula 3A, Formula 4A and Formula 5A, and said compound having a hindered amine unit is selected from the group consisting of Formula 1B, Formula 2B, Formula 3B, Formula 4B, Formula 5B Formula 6B:

Formula 1A

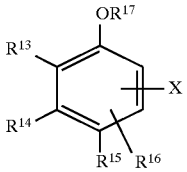

wherein $R^{13}$ represents a branched alkyl group, $R^{14}$, $R^{15}$ and $R^{16}$ independently represent a hydrogen atom, a hydroxyl group, an alkyl group or an aryl group, $R^{15}$ and $R^{16}$ may combine together to form a ring, $R^{17}$ represents a hydrogen atom, an alkyl group or an alkylidene group, X represents a hydrogen atom or an organic residue, Formula 2A

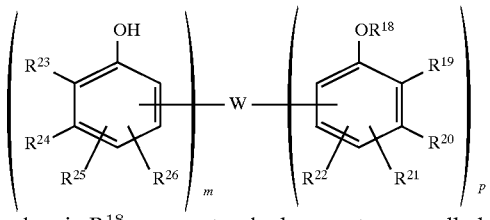

wherein $R^{18}$ represents a hydrogen atom, an alkyl group, an aryl group or an aralkyl group, $R^{19}$ and $R^{23}$ independently represent a branched alkyl group, $R^{20}$, $R^{21}$, $R^{22}$, $R^{24}$, $R^{25}$ and $R^{26}$ independently represent a hydrogen atom or a substituent, m and p independently represent 0 or a positive integer, and the sum of m and p is 2 to 4, W is a binding group, Formula 3A

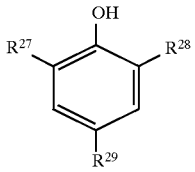

wherein $R^{27}$, $R^{28}$ and $R^{29}$ independently represent an alkyl group, Y' is an organic residue, Formula 4A

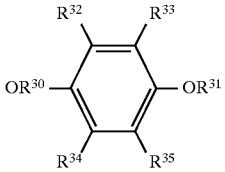

wherein $R^{30}$ and $R^{31}$ independently represent an alkyl group, an alkenyl group, a cycloalkyl group, an aryl group or a heterocyclic group, $R^{32}$, $R^{33}$, $R^{34}$ and $R^{35}$ independently represent a hydrogen atom, a halogen atom, an alkyl group, an alkenyl group, a cycloalkyl group, an aryl group, an alkoxyl group, an alkylthio group, an aryloxyl group, an arylthio group, an acyl group, an acylamino group, an alkylamino group, an alkoxycarbonyl group or a sulfonamide group, Formula 5A

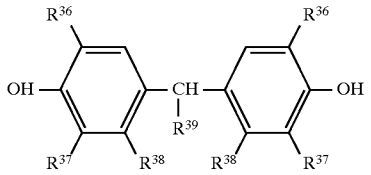

Formula 5A wherein $R^{36}$ represents an alkyl group having 1 to 18 carbon atoms, $R^{37}$ and $R^{38}$ independently represent a hydrogen atom or an alkyl group having 1 to 18 carbon atoms, $R^{39}$ represents a hydrogen atom or an alkyl group having 1 to 10 carbon atoms,

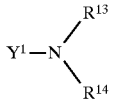

Formula 1B wherein $R^{13}$ and $R^{14}$ independently represent an alkyl group, provided that either of $R^{13}$ and $R^{14}$ is a branched alkyl group, Y' is an organic residue,

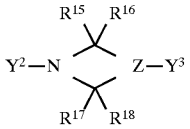

Formula 2B wherein $R^{15}$, $R^{16}$, $R^{17}$ and $R^{18}$ independently represent a hydrogen atom, an alkyl group or an aryl group, Z represents a group of atoms necessary to form a nitrogen-containing aliphatic ring, $Y^2$ and $Y^3$ independently represent a hydrogen atom or an organic residue,

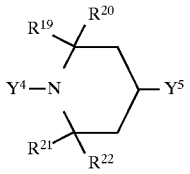

Formula 3B

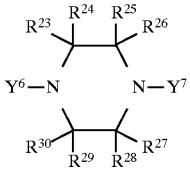

Formula 4B

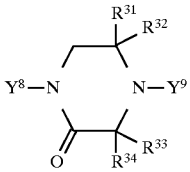

Formula 5B

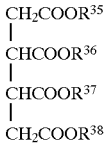

Formula 6B wherein $R^{19}$ through $R^{34}$ independently represent a hydrogen atom or an alkyl group, $R^{35}$ through $R^{38}$ independently represent

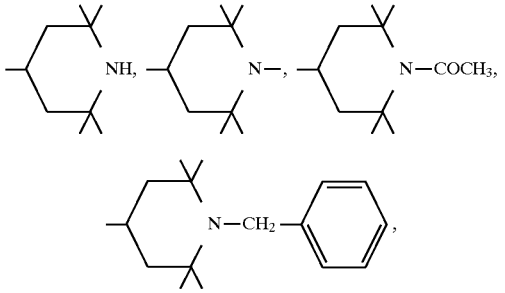

$Y^4$ through $Y^9$ independently represent a hydrogen atom or an organic residue.

6. The electrophotographic photoreceptor of claim 1, wherein said compound having a hundred phenolic unit is selected from the group consisting of Formula 1A, Formula 2A, Formula 3A, Formula 4A and Formula 5A.

7. The electrophotographic photoreceptor of claim 6, wherein said compound having a hindered phenolic unit is Formula 3A or Formula 5A.

8. The electrophotographic photoreceptor of claim 1, wherein said compound having a hindered phenolic unit is (A)-3:

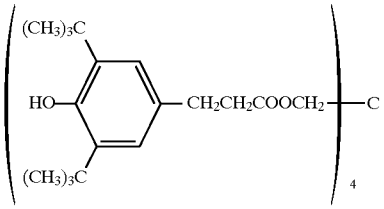

(A)-3

9. The photoreceptor of claim 1 wherein said Formula $B_1$ is Formula B and said Formula $B_2$ is Formula C

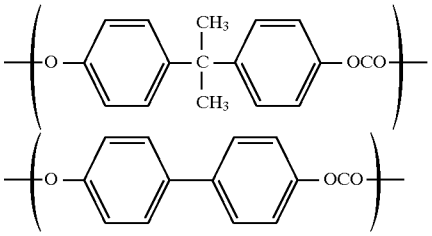

Formula B

Formula C

10. The photoreceptor of claim 1 wherein said compound having a hindered amine unit is selected from the group consisting of compounds represented by Formula 1B, Formula 2B, Formula 3B, Formula 4B, Formula 5B, and Formula 6B

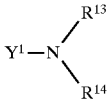

Formula 1B wherein $R^{13}$ and $R^{14}$ independently represent alkyl, provided that either of $R^{13}$ and $R^{14}$ is branched alkyl,

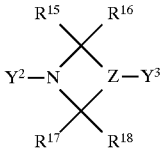

Formula 2B wherein $R^{15}$, $R^{16}$, $R^{17}$ and $R^{18}$ independently represent hydrogen, alkyl or aryl, Z represents a group of atoms necessary to form a nitrogen-containing aliphatic ring, Y' is an organic residue, $Y^2$ and $Y^3$ independently represent hydrogen or an organic residue, Formula 3B

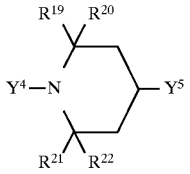

Formula 4B

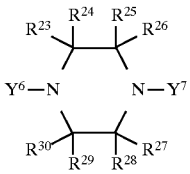

Formula 5B

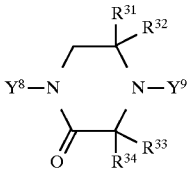

Formula 6B

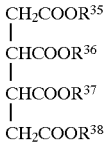

wherein $R^1$ through $R^{34}$ independently represent hydrogen or alkyl, $R^{35}$ through $R^{38}$ independently represent

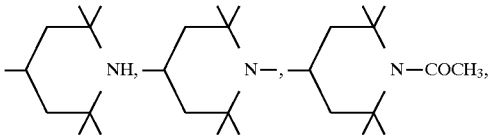

-continued

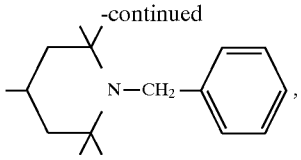

and $Y^4$ through $Y^9$ independently represent hydrogen or an organic residue.

11. The electrophotographic photoreceptor of claim 1 wherein said light-sensitive layer further comprises a carrier transport material represented by Formula U:

Formula U

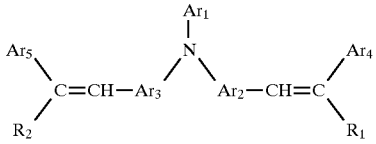

wherein $Ar_1$ represents phenyl substituted by $(R_3)i$ or a condensed polycyclic hydrocarbon, a heterocyclic or a condensed polycyclic heterocyclic, $Ar_2$ and $Ar_3$ independently represent phenyl substituted by $(R_4)j$ or a condensed polycyclic hydrocarbon, a heterocyclic or a condensed polycyclic heterocyclic, $Ar_4$, $Ar_5$, $R_1$ and $R_2$ independently represent phenyl substituted by $(R_5)k$ or a condensed polycyclic hydrocarbon, a heterocyclic or a condensed polycyclic heterocyclic, $R_1$ and $R_2$ may combine with $Ar_4$ and $Ar_5$ to form a ring, $R_3$ represents alkyl, phenyl, alkoxyl, phenoxyl, cyano, halogen, carboxyl, acyl, hydroxyl, nitro, amino, alkylamino, cyclic hydrocarbon, a condensed polycyclic hydrocarbon or a heterocyclic, $R_4$ and $R_5$ independently represent alkyl, phenyl, alkoxyl, phenoxyl, cyano, halogen, carboxyl, acyl, hydroxyl, nitro, amino, alkylamino, arylamino, aralkylamino, cyclic hydrocarbon, a condensed polycyclic hydrocarbon or a heterocyclic, i and k independently represent an integer of 0 to 5, and j represents an integer of 0 to 4.

12. The photoreceptor of claim 1 wherein said light-sensitive layer contains an electron recipient.

13. The photoreceptor of claim 12 wherein said electron recipient is selected from the group consisting of maleic anhydride, chloranil, and 2,4,7-trinitrofluorenone.

* * * * *